US007090018B2

(12) United States Patent
Livingstone

(10) Patent No.: US 7,090,018 B2
(45) **Date of Patent: *Aug. 15, 2006**

(54) REVERSE CIRCULATION CLEAN OUT SYSTEM FOR LOW PRESSURE GAS WELLS

(75) Inventor: James I. Livingstone, Calgary (CA)

(73) Assignee: Presgsol Ltd., Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 10/622,582

(22) Filed: Jul. 21, 2003

(65) Prior Publication Data

US 2004/0104030 A1 Jun. 3, 2004

Related U.S. Application Data

(60) Provisional application No. 60/396,717, filed on Jul. 19, 2002.

(51) Int. Cl.
*E21B 21/00* (2006.01)

(52) U.S. Cl. ..... 166/312; 166/77.2

(58) Field of Classification Search ..... 175/213, 175/215, 324, 70, 65, 206, 207, 325
See application file for complete search history.

(56) References Cited

U.S. PATENT DOCUMENTS

| | | | | |
|---|---|---|---|---|
| 2,167,393 | A * | 7/1939 | Muncy | 175/49 |
| 2,537,605 | A * | 1/1951 | Sewell | 175/205 |
| 2,609,836 | A | 9/1952 | Knox | |
| 2,659,046 | A * | 11/1953 | Arps | 324/323 |
| 3,075,589 | A | 1/1963 | Grable et al. | |
| 3,416,618 | A * | 12/1968 | Kunnemann | 175/339 |
| 3,770,006 | A | 11/1973 | Sexton et al. | |
| 3,792,429 | A | 2/1974 | Patton et al. | |
| 3,795,283 | A | 3/1974 | Oughton | |
| 3,920,090 | A | 11/1975 | McQueen et al. | |
| 4,055,224 | A | 10/1977 | Wallers | |
| 4,100,528 | A | 7/1978 | Bernard et al. | |
| 4,219,087 | A | 8/1980 | Johnson | |
| 4,243,252 | A | 1/1981 | Johnson | |
| 4,321,974 | A | 3/1982 | Klemm | |

(Continued)

FOREIGN PATENT DOCUMENTS

CA 1325969 10/1987

(Continued)

OTHER PUBLICATIONS

U.S. Appl. No. 10/644,749, filed Aug. 21, 2003 by James Livingstone.*

(Continued)

*Primary Examiner*—Frank Tsay
(74) *Attorney, Agent, or Firm*—Bennett Jones LLP

(57) ABSTRACT

The present invention provides an apparatus and a method for removing undesirable material from a well bore in a hydrocarbon formation with minimum damage to the formation. The apparatus comprises a concentric tubing string, said concentric tubing string further comprising an inner tube means having an inner annulus therethrough and an outer tube means forming an outer annulus between said outer tube means and said inner tube means, means for introducing into said well bore a pressurized clean out medium through one of the said inner annulus and outer annulus, and means for removing said material and clean out medium through the other of the said inner annulus and said outer annulus to the surface of said well bore. In a preferred embodiment, the introducing means comprises a discharge compressor or mud pump and the removing means comprises a suctioning compressor.

155 Claims, 16 Drawing Sheets

U.S. PATENT DOCUMENTS

| | | | | | |
|---|---|---|---|---|---|
| 4,391,328 | A | | 7/1983 | Aumann | |
| 4,431,069 | A | | 2/1984 | Dickinson, III et al. | |
| 4,461,448 | A | | 7/1984 | Huey et al. | |
| 4,463,814 | A | | 8/1984 | Horstmeyer et al. | |
| 4,509,606 | A | | 4/1985 | Willis | |
| 4,534,426 | A | * | 8/1985 | Hooper | 175/65 |
| 4,647,002 | A | | 3/1987 | Crutchfield | |
| 4,671,359 | A | | 6/1987 | Renfro | |
| 4,681,164 | A | | 7/1987 | Stacks | |
| 4,705,119 | A | | 11/1987 | Kostylev et al. | |
| 4,709,768 | A | | 12/1987 | Kostylev et al. | |
| 4,718,503 | A | * | 1/1988 | Stewart | 175/70 |
| 4,739,844 | A | * | 4/1988 | Farris et al. | 175/215 |
| 4,744,420 | A | | 5/1988 | Patterson et al. | |
| 4,790,391 | A | | 12/1988 | Hamamura et al. | |
| 4,832,126 | A | | 5/1989 | Roche | |
| 5,006,046 | A | | 4/1991 | Buckman et al. | |
| 5,020,611 | A | | 6/1991 | Morgan et al. | |
| 5,033,545 | A | | 7/1991 | Sudol | |
| 5,068,842 | A | | 11/1991 | Naito | |
| 5,174,394 | A | * | 12/1992 | Fischer et al. | 175/213 |
| 5,178,223 | A | * | 1/1993 | Smet | 175/424 |
| 5,199,515 | A | * | 4/1993 | Sinclair et al. | 175/213 |
| 5,236,036 | A | | 8/1993 | Ungemach et al. | |
| 5,285,204 | A | | 2/1994 | Sas-Jaworsky | |
| 5,348,097 | A | | 9/1994 | Giannesini et al. | |
| 5,396,966 | A | | 3/1995 | Roos, Jr. et al. | |
| 5,411,105 | A | | 5/1995 | Gray | |
| 5,435,395 | A | | 7/1995 | Connell | |
| 5,513,528 | A | | 5/1996 | Holenka et al. | |
| 5,575,451 | A | | 11/1996 | Colvin et al. | |
| 5,638,904 | A | | 6/1997 | Misselbrook et al. | |
| 5,720,356 | A | * | 2/1998 | Gardes | 175/62 |
| 5,881,813 | A | | 3/1999 | Brannon et al. | |
| 5,890,540 | A | | 4/1999 | Pia et al. | |
| 5,892,460 | A | | 4/1999 | Jerabek et al. | |
| 6,015,015 | A | | 1/2000 | Luft et al. | |
| 6,047,784 | A | | 4/2000 | Dorel | |
| 6,065,550 | A | | 5/2000 | Gardes | |
| 6,109,370 | A | | 8/2000 | Gray | |
| 6,158,531 | A | | 12/2000 | Vail, III | |
| 6,189,617 | B1 | | 2/2001 | Sorhus et al. | |
| 6,192,985 | B1 | | 2/2001 | Hinkel et al. | |
| 6,196,336 | B1 | | 3/2001 | Fincher et al. | |
| 6,209,663 | B1 | | 4/2001 | Hosie | |
| 6,209,665 | B1 | | 4/2001 | Holte | |
| 6,213,201 | B1 | | 4/2001 | Renkis | |
| 6,250,383 | B1 | | 6/2001 | Patel | |
| 6,263,987 | B1 | | 7/2001 | Vail, III | |
| 6,325,159 | B1 | | 12/2001 | Peterman et al. | |
| 6,347,675 | B1 | * | 2/2002 | Kolle | 175/69 |
| 6,359,438 | B1 | | 3/2002 | Bittar | |
| 6,367,566 | B1 | * | 4/2002 | Hill | 175/57 |
| 6,377,050 | B1 | | 4/2002 | Chemali et al. | |
| 6,394,197 | B1 | | 5/2002 | Holte | |
| 6,405,809 | B1 | | 6/2002 | Patel et al. | |
| 6,481,501 | B1 | | 11/2002 | Chavez et al. | |
| 2002/0000332 | A1 | | 1/2002 | Merecka et al. | |
| 2003/0141111 | A1 | | 7/2003 | Pia | |
| 2003/0150621 | A1 | | 8/2003 | Pia | |
| 2003/0155156 | A1 | * | 8/2003 | Livingstone | 175/57 |
| 2003/0173088 | A1 | * | 9/2003 | Livingstone | 166/324 |
| 2004/0079553 | A1 | * | 4/2004 | Livingstone | 175/61 |

FOREIGN PATENT DOCUMENTS

| | | | |
|---|---|---|---|
| EP | 0787886 | | 5/1997 |
| EP | 1 245 783 | | 2/2002 |
| FR | 2597150 | | 4/1986 |
| GB | 2368079 | | 10/2000 |
| WO | WO 97/05361 | | 2/1997 |
| WO | WO 97/35093 | | 9/1997 |
| WO | WO 00/57019 | | 9/2000 |
| WO | WO 200120124 | A1 * | 3/2001 |
| WO | WO 01/90528 | | 11/2001 |
| WO | WO 02/10549 | | 2/2002 |

OTHER PUBLICATIONS

Underbalanced Drilling; Nowsco, not dated.

Nowsco/Downhole Systems: "Test, Treat, Test System Using a Concentric Coiled Tubing/DST Package": Hoyer, Fried & Sask, not dated.

BlackMax Downhole Tools; An NQL Drilling Tools Inc. Company; Electro Magnetic Measurement While Drilling; Oil & Gas Application; EM=MWD, not dated.

Logging While Drilling; http://www.odp.tamu.edu/publications/196_IR/chap_2/c2_.htm, not dated.

Drilling and Formation Evaluation; Baker Hughes; www.bakerhughes.com/bakerhughes/products/well.htm, not dated.

On Trak MWD System; Baker Hughes; www.bakerhughes.com/inteq/evaluation/ontrak/index.htm, not dated.

Press TEQ Application Examples; Baker Hughes; www.bakerhughes.com/inteq/D&P/pressure/index.htm, not dated.

Thruster Drilling System; Baker Hughes; www.bakerhughes.com/inteq/Drilling/thruster/index.htm, not dated.

Coiled Tubing; Baker Hughes; Baker Oil Tools Coiled Tubing Solutions; www.bakerhughes.com/bot/coiled_tubing/index/htm, not dated.

COLT Coil Tubing Drilling Bottom Hole Assembly; Antech Special Engineering Products; Coiled Tubing Downhole Tools, not dated.

U.S. Appl. No. 10/644,749, filed on Aug. 21, 2003 by James Livingstone.

* cited by examiner

680

680

REVERSE CIRCULATION CLEAN OUT SYSTEM FOR LOW PRESSURE GAS WELLS

This application claims the benefit of U.S. Provisional Application No. 60/396,717, filed on Jul. 19, 2002.

FIELD OF THE INVENTION

The present invention relates generally to an apparatus for insertion in a well bore and a method associated therewith for removal of undesirable material. More particularly, the present invention relates to a clean out system utilizing at least two compressors together with concentric drill pipe, concentric coiled tubing, or single wall tubing inserted into the well casing.

BACKGROUND OF THE INVENTION

In hydrocarbon producing wells, it is desirable to remove accumulated solid particles, sediment, and/or injection fluids, such as fracturing acids, sands and drilling fluids from the well bore to avoid restriction of the flow of hydrocarbons caused by such materials. When removing such materials it is important to keep formation damage to a minimum to ensure maximum production. This is particularly important when attempting to clean out low and under pressure reservoirs which are more susceptible to formation damage.

The drilling of low or under pressure reservoirs is quickly becoming more prevalent as conventional (i.e. normal pressure) sources of oil and gas become depleted. Currently in the United States, over 26% of the total gas production comes from low permeability or tight reservoirs, shallow gas wells, coal bed methane and shale gas. However, recovery of oil and gas from these low or under pressure reservoirs is difficult due to drilling damage, well stimulation damage and well completion damage. Such damage can make the difference between a commercial well or an abandoned well.

Conventional clean out methods and corresponding apparatus involve the pumping of high pressure air or fluids down a well bore. High pressure delivery of clean out fluid is necessary to lift undesirable material such as fracturing sand, drill cuttings, formation shales, stimulation acid, cement and the like to the surface. Unfortunately, the lifting pressures used will often exceed the formation pressure thereby forcing the accumulated materials into the production zones. This is particularly prevalent when dealing with the clean out of a low or under pressure reservoir. Zones which have the most porosity and permeability produce the most and damage the easiest.

Open hole completions can pose problems when performing conventional clean out operations because well bore material such as shale can collapse the well bore, cave it in, or fill up the well bore past the productive zones. Formation water from a zone can also shut-off or restrict flow from the productive zones.

As well, certain swelling clays such as bentonite can be present in producing formations. If water contacts these clays during conventional clean out operations, these clays can swell and permanently damage the producing formations.

Conventional clean out operations can also cause considerable damage to coal bed methane wells, which most often are completed open hole and are usually very low pressure. Coal is much softer than rock and it can be pulverized during drilling or clean out operations. The small particles of coal which result from this pulverization process are forced into the fractures in the coal seams by the current clean out and well drilling technology. This greatly reduces the ability of the methane gas to flow freely from the fractures in the coal and into the open hole well bore.

The present invention addresses some of the problems associated with conventional clean out procedures.

SUMMARY OF THE INVENTION

The present invention allows for the clean out of well bores in a safe manner, and with less damage to the formation. This is particularly important because clean out operations generally have to be repeated several times over a period of several weeks to ensure optimum production. The invention works particularly well in low and under pressure hydrocarbon formations where existing clean out technologies can easily damage the formation.

The present invention can be used with either a cased well bore, which has production casing run from the bottom to the top of the well bore, or an open hole (i.e. a barefoot completion) well bore, which has casing set just above the first production zone and the rest of the well bore is left without any casing in place. Occasionally, you can have an upper zone cased and a lower zone open hole, if the producing zones are from a different formation, or the zones are a considerable distance apart.

The present invention can be used to clean out vertical, deviated, or horizontal well bores, that have become blocked or restricted from formation material such as shale, stimulation material such as fracturing sand or acid, drilling fluids and cuttings.

The present invention addresses a number of problems currently associated with today's technology for cleaning out low and under pressured well bores as follows:

(1) The overpressure situation in the well bore needed to lift the material out of the well is reduced by using two compressors, a discharge compressor and a suction compressor.

(2) The majority of material being cleaned out of the well bore doesn't have to travel past the productive zones while being lifted out of the well as the material travels up the outer annulus or inner space of the clean out apparatus, thereby resulting in reduced formation damage.

(3) Use of a down hole blowout preventor controls an overpressure situation in the well bore and prevents an uncontrolled flow to surface once the material has been cleaned away from the producing zone.

(4) The double wall drill pipe, the coiled-in-coiled tubing, or the tubing inside the well bore of the clean out apparatus can be tripped out of the well safely once the clean out is completed due to the use of two blowout preventors, namely a surface blowout preventor and a downhole blowout preventor.

In the present invention, the discharge compressor or mud pump is operated such that the discharge pressure at the formation is substantially at the pressure of the producing formation, so that air or fluid pressure being pushed down is no greater than the pressure of the formation. This prevents any of the material that is being cleaned out of the well bore or flowed back from the formation from moving up the well bore annulus to surface as the clean out is taking place and thus the well may continue to produce hydrocarbons or at the very least the material to be cleaned out will not flow past the producing formation and will not further damage the producing formation by entering, plugging, or scouring the production formation.

The second compressor, the suction compressor, suctions up the clean out material and deposits the material in a pit or tank at surface. In one embodiment, the suction compressor is attached at surface to the inside string of either dual wall drill pipe or the inside coiled tubing of concentric coiled tubing string and the material is moved through this inner annulus to surface.

Some well applications will require a mud pump instead of a discharge compressor to push different fluids or drilling mud down the annulus between the inner drill string or inner coiled tubing string and the outer wall of the dual wall drill pipe or concentric coiled tubing string, in order to effectively complete the clean out procedure.

These fluids or drilling mud are pumped down hole by a mud pump at pressures not exceeding the formation pressure. The exhaust fluids or drilling mud will exit the well bore up through the inner string of the concentric drill pipe or coiled in coiled tubing, along with the material that is being cleaned out of the well bore. The suction compressor at surface, if required, can supply enough suction to carry the clean out material, fluids or drill mud to surface, and then the surface flow equipment will deposit it in a designated pit or tank.

In the alternative, drilling mud or drilling fluid can be pumped downhole through the inner string and clean out materials removed through the outer annulus.

Thus, the present invention allows the fluids or drill mud to leave the well bore without being forced up the well bore annulus and pushed against the formation, all of which can cause formation damage. Again, if the formation starts to flow hydrocarbons in an uncontrolled manner during well clean out, both or either of the down hole and surface blowout preventors can be activated to maintain or regain well control. Both blowout preventors can be used to safely trip out the dual wall drill pipe or production tubing from the well bore.

The invention allows for various clean out tools, drill bits, or air hammers to be attached to the bottom hole assembly to carrying out a wide range of clean out functions inside the production casing.

The present invention can be used with various types of oilfield equipment that are used in the service sector of the oil and gas industry. Drilling and service rigs can run the dual wall (concentric) drill pipe, along with the discharge and suction compressors, blowout preventors and surface flow equipment necessary for the clean out operation.

The present invention can use coiled-in-coiled tubing string and coiled-in-coiled tubing truck-mounted portable rigs that provide the discharge and suction compressors, blow out preventors, and surface flow equipment necessary for the clean out operation.

The present invention can also be used where production tubing has been placed inside the producing well bore. The first annulus between the outer wall of the production tubing and the inner wall of the well bore is used to introduce pressurized gas or fluids. A discharge compressor will be attached to the first annulus. The annulus of the production tubing forms the second annulus where the suction compressor is attached. Both compressors are connected to the wellhead at surface, along with the surface blow out preventor, when required, and the necessary surface flow equipment. A variety of clean out tools, drill bits, and air hammers can be attached to the bottom of the production tubing to facilitate the clean out. Where regulatory and safety concerns require the use of the down hole blow out preventor, this device will be part of the bottom hole assembly connected to the bottom of the production tubing. In the alternative, single wall coiled tubing can be used in place of production tubing.

Thus, in a first embodiment, the present invention provides a method for removing material from a well bore extending from a ground surface into a hydrocarbon formation having a pressure, comprising the steps of:

delivering into said well bore a concentric tubing string, said concentric tubing string comprising an inner tube means having an inner space therethrough and an outer tube means forming an outer annulus between said outer tube means and said inner tube means;

introducing into said well bore a pressurized clean out medium through one of the said inner space and outer annulus; and removing said material and clean out medium through the other of the said inner space and said outer annulus to the surface of said well bore.

The concentric tubing string can either be a concentric drill pipe string or a concentric coiled tubing string.

In a preferred embodiment, the pressurized clean out medium is introduced into the well bore at a pressure substantially equal to or below the pressure of the formation.

The clean out medium is generally selected from the group consisting of drilling mud, drilling fluid, air, gas, acids and a mixture of drilling fluid and gas and can be introduced into the well bore by a discharging means operably connected near the top of said concentric tubing string in such a fashion as to be in communication with either the inner space or the outer annulus. The discharging means can be either a mud pump or a discharging compressor, depending upon the clean out medium being used.

The clean out medium is removed by a suctioning means which is operably connected near the top of the concentric tubing string and is in communication with either the inner space or the outer annulus. In one embodiment, the suctioning means is a suctioning compressor. The suctioning means can further comprise a flare means for flaring any gaseous hydrocarbons produced from the well bore.

The concentric tubing string is usually equipped with a downhole flow control means located at or near the bottom of the concentric tubing string for preventing flow of hydrocarbon from the inner space, the outer annulus or both to the surface of the well bore. In a preferred embodiment, the downhole flow control means is controlled at the surface of the well bore by a surface control means.

In a preferred embodiment, the clean out method further comprises the step of providing a clean out tool at or near the bottom of said concentric tubing string for disturbing said material in said well bore. In one embodiment, the clean out tool is a reciprocating clean out tool comprising a clean out means having a plurality of teeth and a reciprocating piston.

In one embodiment of the present clean out method, the pressurized clean out medium is introduced into the well bore through the outer annulus and the material and the clean out medium is removed through the inner space. In another embodiment, the pressurized clean out medium is introduced into the well bore through the inner space and the material and the clean out medium is removed through the outer annulus.

The present invention further provides an apparatus for removing material from a well bore extending from a ground surface into a hydrocarbon formation having a pressure, comprising:

a concentric tubing string, said concentric tubing string comprising an inner tube means having an inner space therethrough and an outer tube means forming an outer annulus between said outer tube means and said inner tube means;

means for introducing into said well bore a pressurized clean out medium through one of the said inner space and outer annulus; and means for removing said material and clean out medium through the other of the said inner space and said outer annulus to the surface of said well bore.

Once again, the concentric tubing string can either be a concentric drill pipe string or a concentric coiled tubing string.

The introducing means is operably connected near the top of the concentric tubing string so as to be in communication with either the inner space or the outer annulus. The introducing means can comprise either a mud pump or a discharging compressor depending upon what clean out medium is being used.

The removing means is operably connected near the top of the concentric tubing string, in communication with either the inner space or the outer annulus, and can comprise a suctioning compressor. The removing means can further comprise a flare means for flaring hydrocarbon produced from the well bore.

In a preferred embodiment, the clean out apparatus further comprises a downhole flow control means located at or near the bottom of the concentric tubing string for preventing flow of hydrocarbon from the inner space, the outer annulus or both to the surface of the well bore. In one embodiment, the downhole flow control means is controlled from the surface by a surface control means.

The clean out apparatus can also comprise a clean out tool located at or near the bottom of the concentric tubing string for disturbing clean out material in the well bore. In one embodiment, the clean out tool is a reciprocating clean out tool comprising a clean out means having a plurality of teeth and a reciprocating piston.

For added safety, the clean out apparatus can further comprise a surface flow control means positioned at or near the surface of the well bore for preventing flow of hydrocarbon from a space between an outside wall of said outer tube means and a wall of the well bore.

When concentric coiled tubing string is used in a preferred embodiment, a bottom hole assembly can be attached to the bottom of the concentric coiled tubing string. In one embodiment, the bottom hole assembly comprises a reciprocating clean out tool, a rotation means attached to the reciprocating clean out tool, a connecting means for connecting the outer tube means and the inner tube means of the concentric coiled tubing string to the reciprocating clean out tool thereby centering said inner tube means within said outer tube means, a disconnecting means located between the connecting means and the reciprocating clean out tool for disconnecting said reciprocating clean out tool from said concentric coiled tubing string, and a downhole blowout preventor.

In a second embodiment of the present invention, a method for removing material from a well bore extending from a ground surface into a hydrocarbon formation having a pressure is provided, comprising the steps of:

delivering into said well bore a production tubing string, said production tubing string having an inner space therethrough and forming an outer annulus between an outer wall of said production tubing string and a wall of said well bore;

introducing into said well bore a pressurized clean out medium through one of the said inner space and outer annulus; and removing said material and clean out medium through the other of the said inner space and said outer annulus to the surface of said well bore.

The method is useful in both cased wells where the well bore further comprises a casing having a plurality of perforations or an open well bore. The method is used to clean out materials such as solid particles, sediment, injection fluids, fracturing acids, sands, drilling fluids and the like.

In a preferred embodiment, the pressurized clean out medium is introduced into the well bore at a pressure substantially equal to or below said pressure of the formation. Clean out medium is selected from the group consisting of drilling mud, drilling fluid, air, gas, acids and a mixture of drilling fluid and gas.

In this embodiment, the production tubing string can be either coiled tubing string or drill pipe string. The pressurized clean out medium can be introduced by a discharging means either operably connected near the top of the production tubing string in communication with the inner space or operably connected to the outer annulus formed between the outer wall of the production tubing string and the wall of the well bore. The discharging means can be either a mud pump or a discharging compressor.

The clean out medium is removed by a suctioning means, commonly a suctioning compressor, which is either operably connected near the top of the production tubing string in communication with the inner space or operably connected to the outer annulus formed between the outer wall of the production tubing string and the wall of the well bore. The suctioning means can further comprise a flare means for flaring hydrocarbon produced from the well bore.

In a preferred embodiment, a downhole flow control means is provided at or near the bottom of the production tubing string for preventing flow of hydrocarbon from the inner annulus to the surface of the well bore. The downhole flow control means can be controlled at the surface of the well bore by a surface control means.

A clean out tool can also be provided at or near the bottom of the production tubing string for disturbing said material in the well bore. Preferably, the clean out tool is a reciprocating clean out tool comprising a clean out means having a plurality of teeth and a reciprocating piston.

In one preferred embodiment, the pressurized clean out medium is introduced into the well bore through the outer annulus and the material and the clean out medium is removed through the inner space. In yet another embodiment, the pressurized clean out medium is introduced into the well bore through the inner space and the material and the clean out medium is removed through the outer annulus.

A surface flow control means positioned at or near the surface of the well bore can also be provided for preventing flow of hydrocarbon from the outer annulus to the surface of the well bore.

The present invention further provides an apparatus for removing material from a well bore extending from a ground surface into a hydrocarbon formation having a pressure, comprising:

a production tubing string, said production tubing string having an inner space therethrough and forming an outer annulus between an outer wall of said production tubing string and a wall of said well bore;

means for introducing into said well bore a pressurized clean out medium through one of the said inner space and outer annulus; and means for removing said material and clean out medium through the other of the said inner data and said outer annulus to the surface of said well bore.

The production tubing string can be drill pipe string or coiled tubing string.

The introducing means can either be operably connected near the top of the production tubing string in communication with the inner data or operably connected to the outer annulus formed between the outer wall of the production tubing string and the wall of the well bore. The introducing means can be a mud pump or a discharging compressor, depending upon the clean out medium used.

The removing means can either be operably connected near the top of the production tubing string in communication with said inner data or operably connected to the outer annulus formed between the outer wall of the production tubing string and the wall of the well bore. In a preferred embodiment, the removing means is a suctioning compressor. The removing means can further comprise a flare means for flaring hydrocarbon produced from the well bore.

The apparatus can further comprise a downhole flow control means at or near the bottom of the production tubing string for preventing flow of hydrocarbon from the inner data to the surface of the well bore. Preferably, the downhole flow control means is controlled by a surface control means for controlling the downhole flow control means at the surface of the well bore.

In another embodiment, the clean out apparatus can further comprise a clean out tool at or near the bottom of the production tubing string for disturbing the material in the well bore. The clean out tool can be a reciprocating clean out tool comprising a clean out means having a plurality of teeth and a reciprocating piston.

The clean out apparatus can further comprise a surface flow control means positioned at or near the surface of the well bore for preventing flow of hydrocarbon from the outer annulus.

When the production tubing used is coiled tubing string, the clean out apparatus can further comprise a bottom hole assembly. In a preferred embodiment, the bottom hole assembly comprises a reciprocating clean out tool, a rotation means attached to the reciprocating clean out tool, a connecting means for connecting said coiled tubing string to the reciprocating clean out tool, and a disconnecting means located between the connecting means and the reciprocating clean out tool for disconnecting the reciprocating clean out tool from the concentric coiled tubing string.

DETAILED DESCRIPTION OF THE PREFERRED EMBODIMENTS

Apparatus and methods of operation of that apparatus are disclosed herein in the preferred embodiments of the invention that allow for clean out of both cased and open hole well bores in hydrocarbon formations. From these preferred embodiments, a person skilled in the art can understand how this reverse circulation clean out process can be used safely in the oil and gas industry. The clean out process of the present invention using drill pipe can use either a service rig or a drilling rig for operation.

Figure 1:
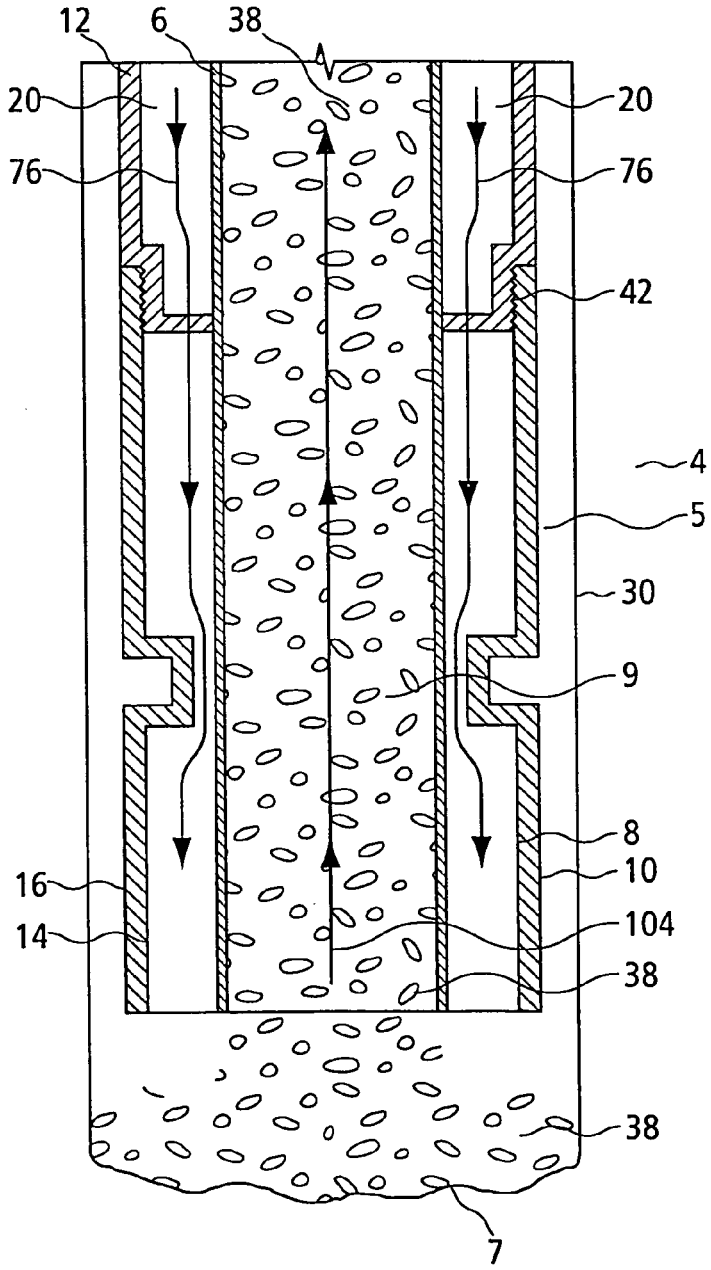
FIG. 1 is a vertical cross-section of a clean out apparatus comprising concentric drill string.

FIG. 1 is a vertical cross-section of a bottom portion of a clean out apparatus 4 of one preferred embodiment of the present invention which has been delivered into a well bore 30. At or near the bottom 7 of said well bore 30 is situated clean out material 38 comprising sand, shale, drill cuttings, drilling fluid and the like, which when removed increases the productivity of well bore 30.

Clean out apparatus 4 comprising concentric drill string 5. Concentric drill string 5 comprises an inner pipe 6 having an inside wall 8 and an outside wall 10 and an outer pipe 12 having an inside wall 14 and an outside wall 16. The diameter of inner pipe 6 and outer pipe 12 can vary; in one embodiment of the invention, the outer diameter of the outer pipe 12 is 4½ inches and the outer diameter of the inner pipe 6 is 2½ inches. Joints of concentric drill string 5 are attached one to another by means such as threading means 42 to form a continuous drill string.

Figure 3:
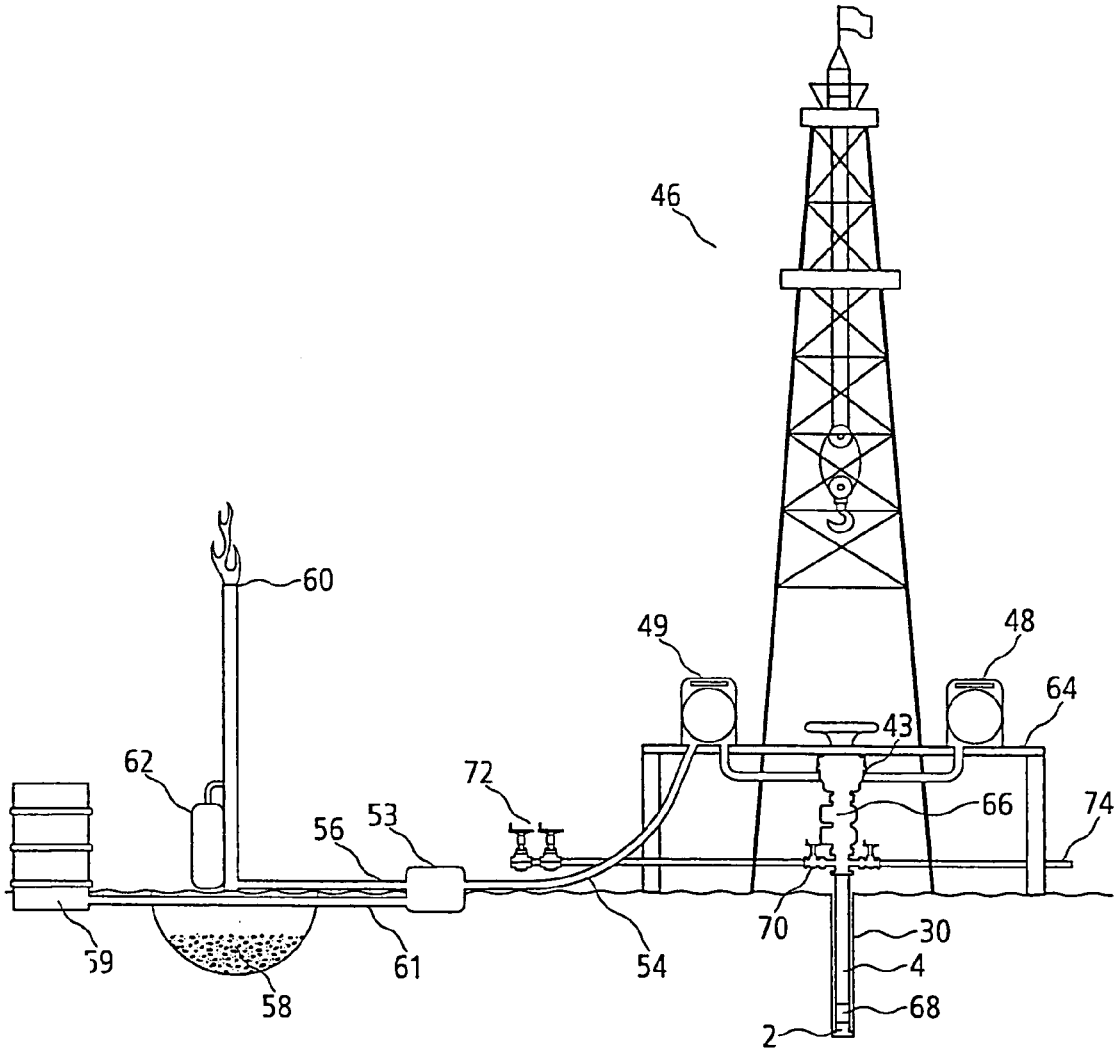
FIG. 3 is a general view showing a partial cross-section of the apparatus and method of the present invention using concentric drill pipe as it is located in a clean out operation.
Figure 13:
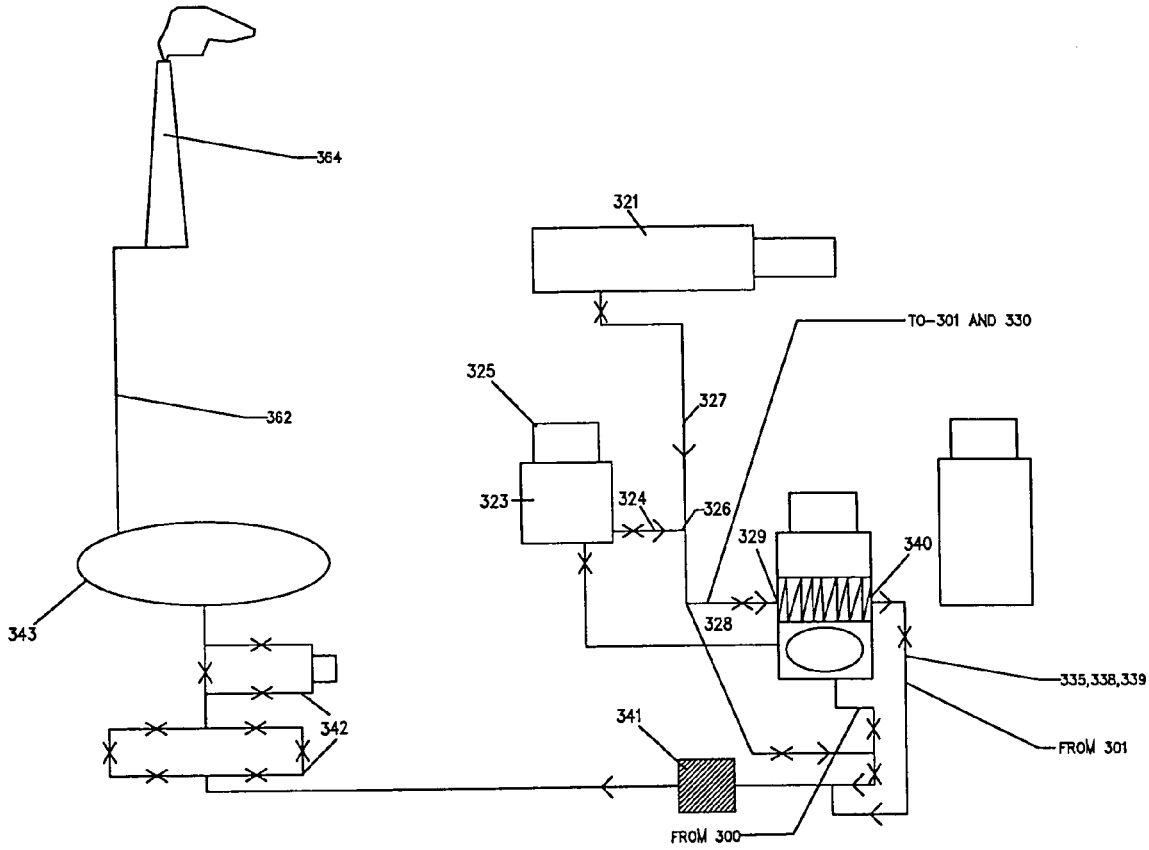
FIG. 13 is a schematic drawing of the operations used for the removal of exhaust clean out medium and clean out material out of the well bore.

Concentric drill string annulus 20 is formed between the outside wall 10 of the inner pipe 6 and the inside wall 14 of the outer pipe 12. Clean out medium 76, for example, drilling mud, fluid such as acids, compressed air or commingled mixtures of drilling mud, fluids, and gases such as nitrogen and carbon dioxide, is pumped down concentric drill string annulus 20 by a discharge means, for example, a discharge compressor 48 for gas as shown in FIG. 3 or a mud pump for drilling mud and drilling fluid as shown in FIG. 13. Clean out material 38 and exhausted clean out medium 104 are removed through inner space 9 of inner pipe 6 aided by means of a suction compressor 49 as shown in FIG. 3, if necessary.

Figure 2:
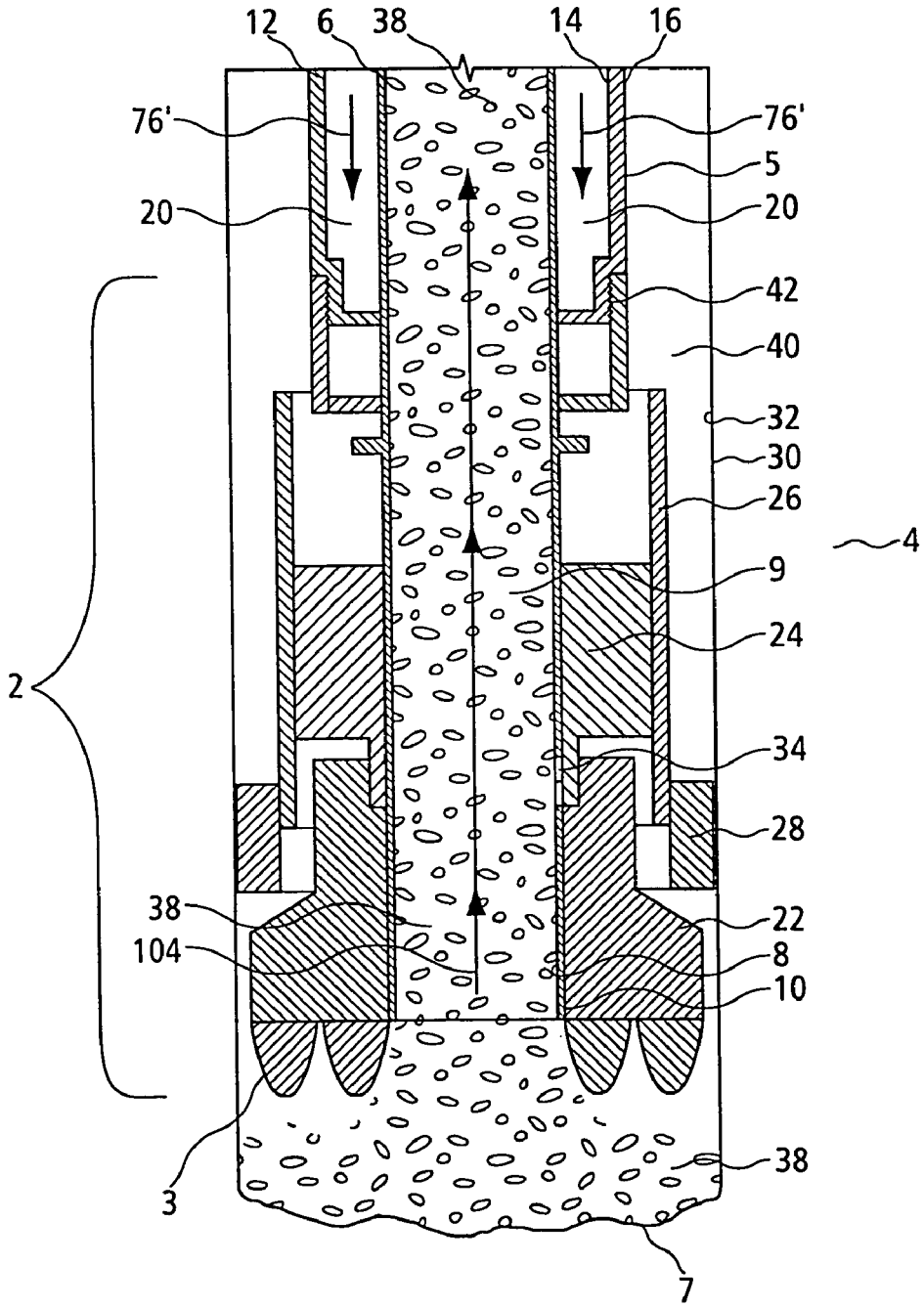
FIG. 2 is a vertical cross-section of a clean out apparatus comprising concentric drill string and clean out tool thereto attached.

FIG. 2 is a vertical cross-section of the bottom portion of clean out apparatus 4 further comprising a clean out tool 2 attached to concentric drill string 5 by threading means 42. Clean out tool is in fluid communication with both the concentric drill string annulus 20 and the inner space 9 of inner pipe 6. Clean out apparatus 4 as shown in this embodiment is operated by compressed air 76' as the clean out medium traveling down concentric drill string annulus 20.

The clean out tool 2 comprises clean out spear 22 having a plurality of impact teeth 3 at its lower end to move clean out materials 38 located at or near the well bore bottom 7. Clean out spear 22 is connected to a reciprocating piston 24 moving within piston casing 26. Venturi 34, positioned between the reciprocating piston 24 and the inner pipe, directs and accelerates exhaust air 104 from the reciprocating piston 24 to the inner pipe 6.

In operation, the compressed air 76' is pumped down concentric drill string annulus 20 by means of discharge compressor 48. Preferably, compressed air 76' is pumped at a pressure substantially equal to or below the pressure of the formation. This is, particularly important when cleaning out low and under pressure well bores. Clean out operations can be performed on either cased wells or open hole wells. With cased wells, the casing (not shown) has open perforations for flow of hydrocarbons. Thus, if conventional, over balanced clean out operations are used, the clean out material can be forced against these perforations due to the pressure exceeding the formation pressure. Similarly, in open hole completed wells, over balanced clean out operations can damage the producing zones by forcing clean out material into these zones.

The compressed air 76' picks up and carries clean out material 38 to inner pipe 6. Exhausted compressed air 104' and clean out material 38 is then suctioned out of inner pipe 6 to the surface of well bore 30 by means of suction compressor 49, if necessary. If there is enough pressure from the discharge compressor 48, there may be sufficient pressure to flow back the clean out material 38 by its own means without the assistance of suction compressor 49.

In a preferred embodiment, a shroud 28 is located between the piston casing 26 and the well bore 30 in relatively air tight and frictional engagement with the inner well bore wall 32. Shroud 28 prevents compressed air 76' and clean out material 38 from escaping up the well bore annulus 40 between the outside wall 16 of the outer pipe 12 of the concentric drill string 4 and the inner well bore wall 32.

In yet another embodiment of the present invention, compressed air 76' can be pumped down the inner space 9 of inner pipe 6 and the clean out material 38 and exhausted compressed air 104' carried to the surface of the well bore through concentric drill string annulus 20.

Reverse circulation clean out of the present invention can also use drilling mud or drilling fluids as well as air to power a rotary clean out tool in the well bore. Mud pumps can be substituted for discharge compressor 48 to push mud or fluids down concentric drill string annulus 20. Clean out material, drilling mud, fluids, acids and the like travel up the inner space 9 of inner pipe 6 to surface of the well bore where they are put into a mud tank or pit. In the alternative, drilling mud or drilling fluids can be pumped down the inner space 9 of inner pipe 6 and the drilling mud or drilling fluids and the clean out material travel up the concentric drill string annulus 20 to the surface of the well bore.

FIG. 3 shows a preferred embodiment of the present method and apparatus for safely cleaning a natural gas well or any well containing hydrocarbon using concentric drill string. Drilling or service rig 46 comprises discharge compressor 48 which is connected to well head 43 and pumps compressed air down the concentric drill string annulus 20 of concentric drill string 4. Clean out apparatus comprises reciprocating clean out tool 2 which is operated as described above to clean out well bore 30. As reciprocating clean out tool 2 cleans out well bore 30, exhausted compressed air, clean out materials and hydrocarbons from formation bearing zones are either moved up inner pipe 6 to the surface of the well bore by its own means or suctioned up inner pipe 6 by means of suction compressor 49.

Connected to suction compressor 49 is discharge line 54, which carries the exhausted compressed air, clean out material and hydrocarbons produced from the well bore to separator 53 where the clean out material is separated from the hydrocarbons. The separated clean out material is then transported through storage line 61 and deposited either in pit 58 or storage tank 59.

The separated gaseous hydrocarbons are transported via blewie line 56 and are flared through flare stack 60 by means of propane torch 62 to atmosphere. Propane torch 62 is kept lit at all times during clean out operations to ensure that all hydrocarbons are kept at least 100 feet away from the drilling or service rig floor 64.

Figure 4:
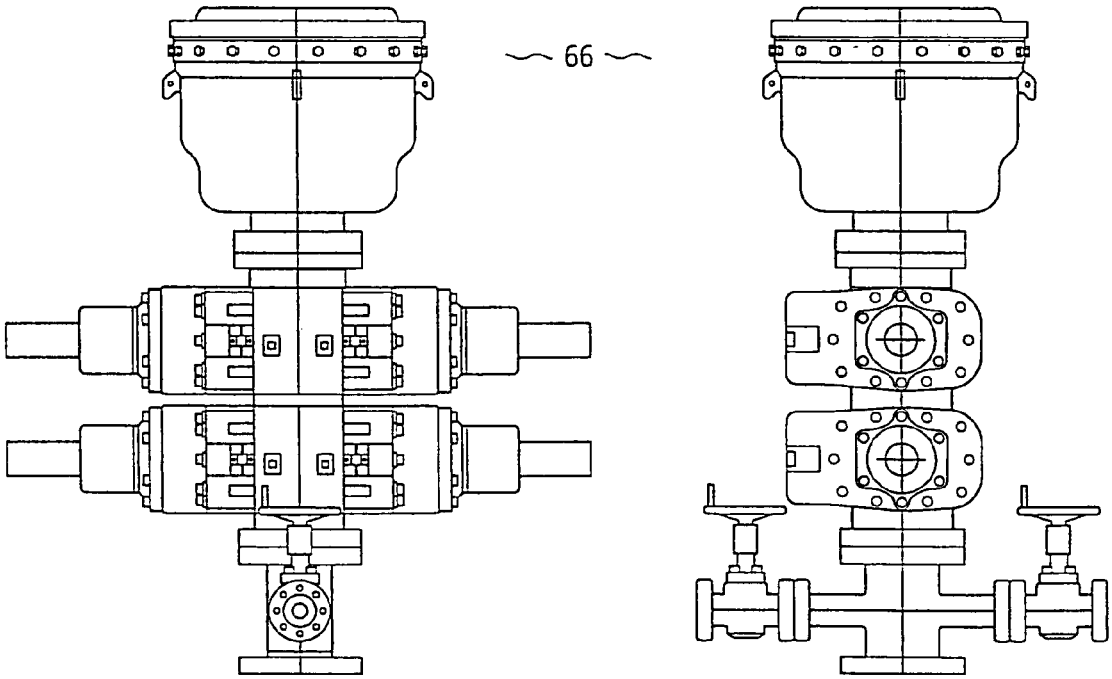
FIG. 4 is a perspective of a surface flow control means.

A surface flow control means or surface annular blowout preventor 66 is used to prevent hydrocarbons from escaping from the formation annulus between the inner well bore wall and the outside wall of the outer pipe of the concentric drill string during certain operations such as tripping concentric drill string in or out of the well bore. An example of a suitable surface annular blowout preventor 66 is shown in FIG. 4. Other surface blowout preventors that can be used are taught in U.S. Pat. Nos. 5,044,602, 5,333,832 and 5,617,917, incorporated herein by reference.

It is preferable that the surface annular blowout preventor contain a circular rubber packing element (not shown) made of neoprene synthetic rubber or other suitable material that will allow the surface annular blowout preventor to seal around the shape of an object used downhole, for example, drill pipe, air hammer, drill bits, and other such drilling and clean out tools.

Surface annular blowout preventor 66 is not equipped to control hydrocarbons flowing up the inside of concentric drill string 4, however. Therefore, a second downhole flow control means or blowout preventor 68 is used to prevent hydrocarbons from coming up inner pipe 6 and concentric drill string annulus 20. For example, when concentric drill string 4 is tripped out of the well bore, downhole flow control means 68 should be in the closed position to ensure maximum safety. This allows for the safe removal of all joints of concentric drill string from the well bore without hydrocarbons being present on the drill rig floor 64. The downhole flow control means 68 is preferably attached at or near the bottom of the clean out apparatus for maximum effectiveness.

Figure 5:
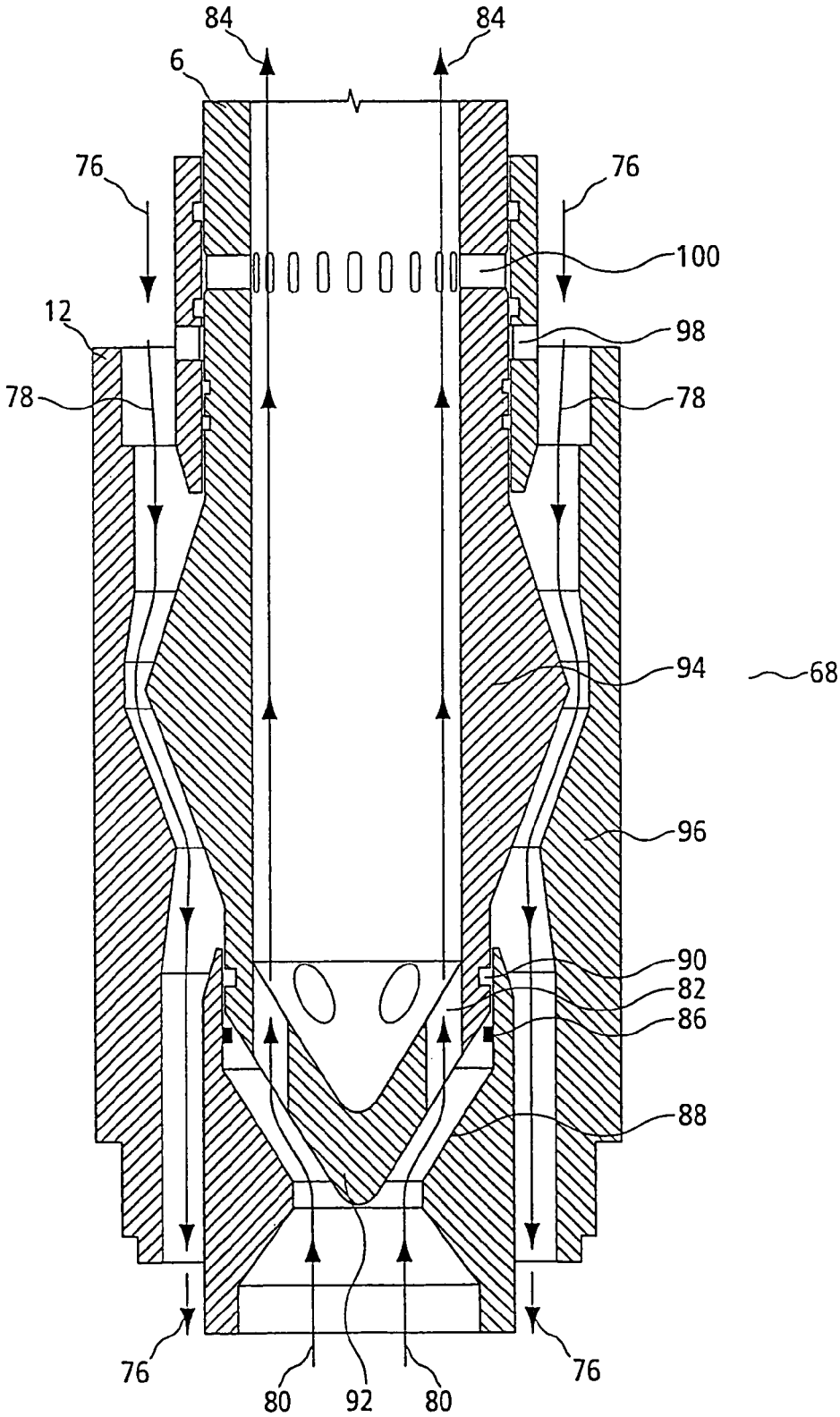
FIG. 5 is a vertical cross-section of one embodiment of a downhole flow control means for concentric drill pipe.

One embodiment of downhole flow control means 68 is shown in greater detail in FIG. 5. This figure shows downhole flow control means 68 in the open position, where clean out medium 76 can flow down concentric drill string annulus 20 and in communication with flow path 78. Clean out medium 76 is allowed to continue through flow control means 68 and communicate with and power the reciprocating clean out tool. Exhausted compressed air, clean out materials and hydrocarbons can flow freely from the reverse circulation of the reciprocating clean out tool either on its own force or assisted by means of the suction action of the suction compressor up flow path 80. Exhausted clean out medium, clean out material and hydrocarbons then flow through ports 82 which allow for communication with the inner pipe 6 through flow path 84.

When desired, flow paths 78 and 80 can be closed by axially moving inner pipe 6 downward relative to outer pipe 12, or conversely moving outer pipe 12 upward relative to inner pipe 6. Inner pipe 6 can be locked into place relative to outer string 12. A friction ring 86 on surface 88 aligns with recess 90 on surface 92 to lock the inner pipe 6 and outer pipe 12 together until opened again by reversing the movement. When in the closed position, surface 92 is forced against surface 88 to close off flow path 80. Similarly, surface 94 is forced against surface 96 to seal off flow path 78. Applying axial tension between the two pipes reverses the procedure, and restores flow through flow path 78 and 80.

An optional feature of flow control means 68 is to provide a plurality of offsetting ports 98 and 100 which are offset while the downhole flow control means is open, but are aligned when the downhole flow control means is in the closed position. The alignment of the plurality of ports 98 and 100 provide a direct flow path between flow paths 78 and 80. This feature would allow for continued circulation through the inner pipe 6 and the concentric drill string annulus 20 for the purpose of continuous removal of clean out material from the concentric drill string while the downhole flow control means 68 is in the closed position.

The downhole flow control means can be used when clean out method uses drilling mud, drilling fluids, gas or various mixtures of the three. However, when the clean out medium used is drilling mud or drilling fluid, an alternate downhole flow control means can be used which only shuts down flow through the inner pipe 6. This is because the hydrocarbons would likely not be able to escape through the drilling mud or drilling fluid remaining in concentric drill string annulus 20. One embodiment of such a downhole flow control means is shown in FIGS. 6*a* and 6*b*, FIGS. 7*a* and 7*b*, FIG. 8 and FIG. 9. This flow control means is further described in more detail in U.S. patent application Ser. No. 10/321,087, incorporated herein by reference.

Figure 6A:
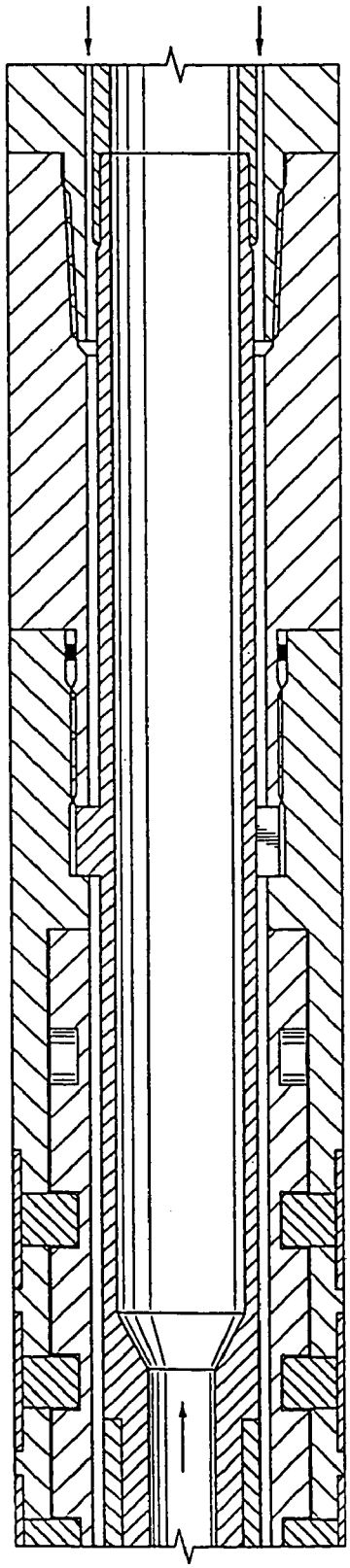
FIGS. 6*a* and 6*b* show a vertical cross-section of the top portion and bottom portion, respectively, of another embodiment of a downhole flow control means for concentric drill pipe in the open position.
Figure 6B:
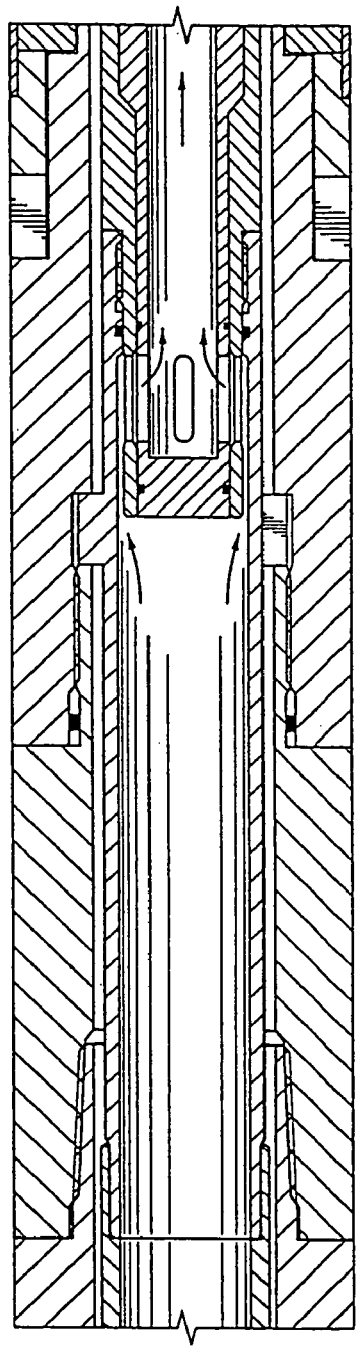
Figure 7A:
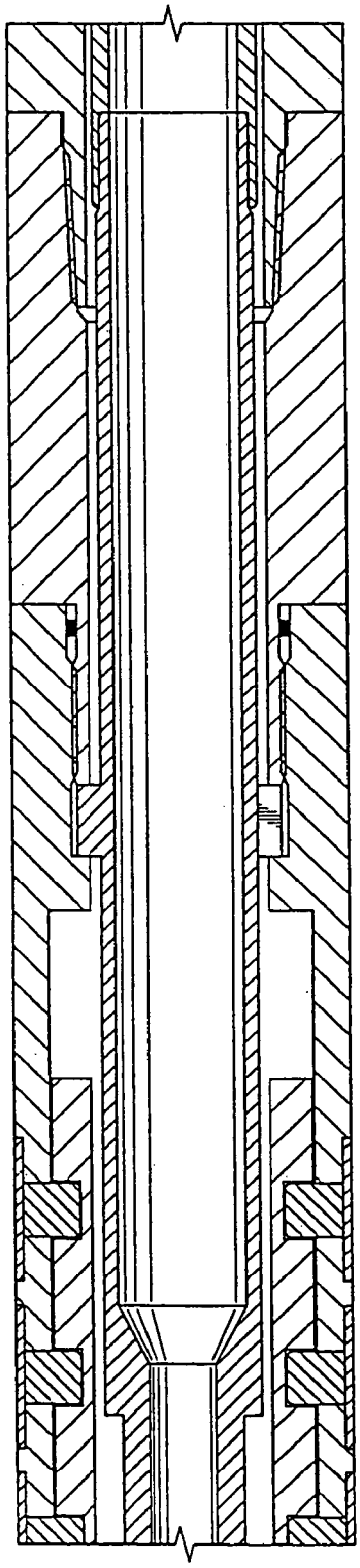
FIGS. 7*a* and 7*b* show a vertical cross-section of the top portion and bottom portion, respectively, of the downhole flow control means shown in 6*a* and 6*b* in the closed position.
Figure 7B:
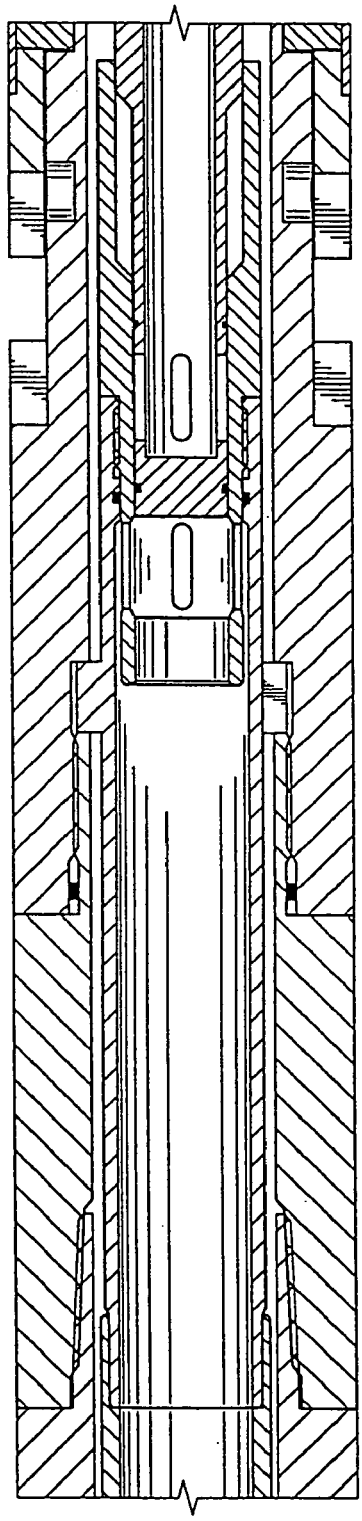
Figure 8:
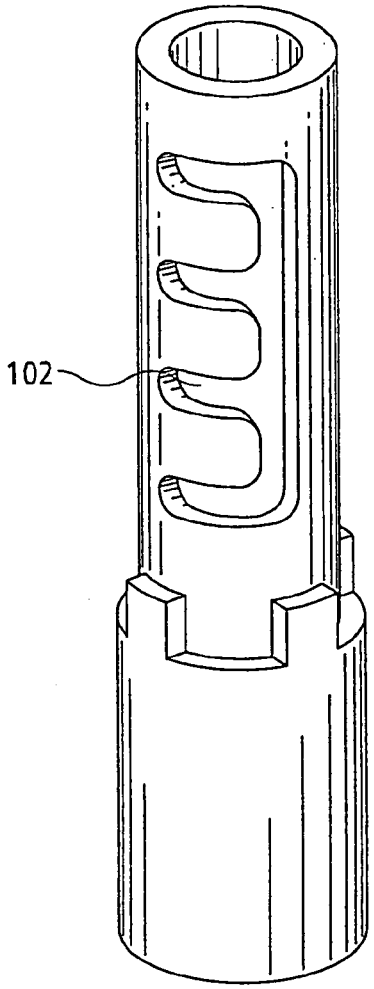
FIG. 8 is a perspective of the plurality of flow through slots of the downhole flow control means shown in 6*a* and 6*b* in the open position.
Figure 9:
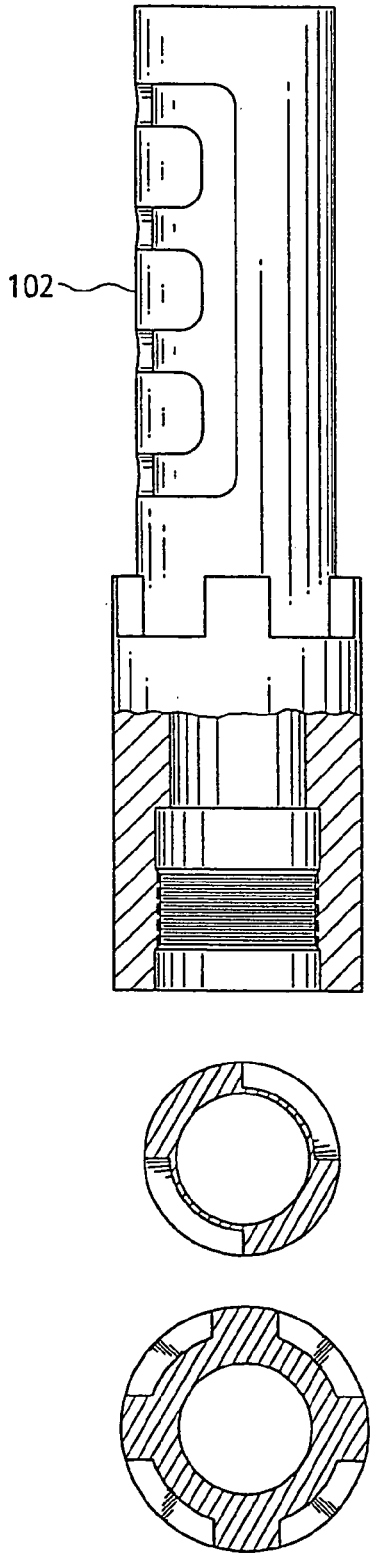
FIG. 9 is a perspective of the plurality of flow through slots of the downhole flow control means shown in 7*a* and 7*b* in the closed position.

FIGS. 6*a* and 6*b* show the downhole flow control means 680 in the open position, where exhausted compressed air, drilling mud or fluids, clean out material and hydrocarbons can flow freely up the concentric drill string attached thereto to the surface of the well bore. FIGS. 7*a* and 7*b* show the downhole flow control means 680 in the closed position. To place the downhole flow control means 680 in the closed position, the concentric drill string must be resting solidly on the bottom of the well bore. The entire concentric drill string is rotated three quarters of one turn to the left. The mechanical turning to left direction closes a plurality of flow through slots 102, shown in FIG. 8 in the open position. The closed position of the downhole flow control means 480 is shown in FIG. 9 where the plurality of flow through slots 102 is in the closed position.

To open the downhole flow control means 480, the downhole flow control means 480 is place solidly on the bottom of the well bore and the entire concentric drill string 480 is rotated back to the right, three quarters of one turn. This will restore the plurality of flow through slots 102 to the open position.

It may occur at times during clean out operations that a "kick" or overpressure situation occurs down in the well bore. If this occurs, both the surface annular blowout preventor 66 and the downhole flow control means 68 would be put into the closed position. Diverter line 70 and manifold choke system 72 would be used to reduce the pressure in the well bore. If this fails to reduce the pressure in the well bore then drilling mud or fluid could be pumped down the kill line 74 to regain control of the well.

Figure 10:
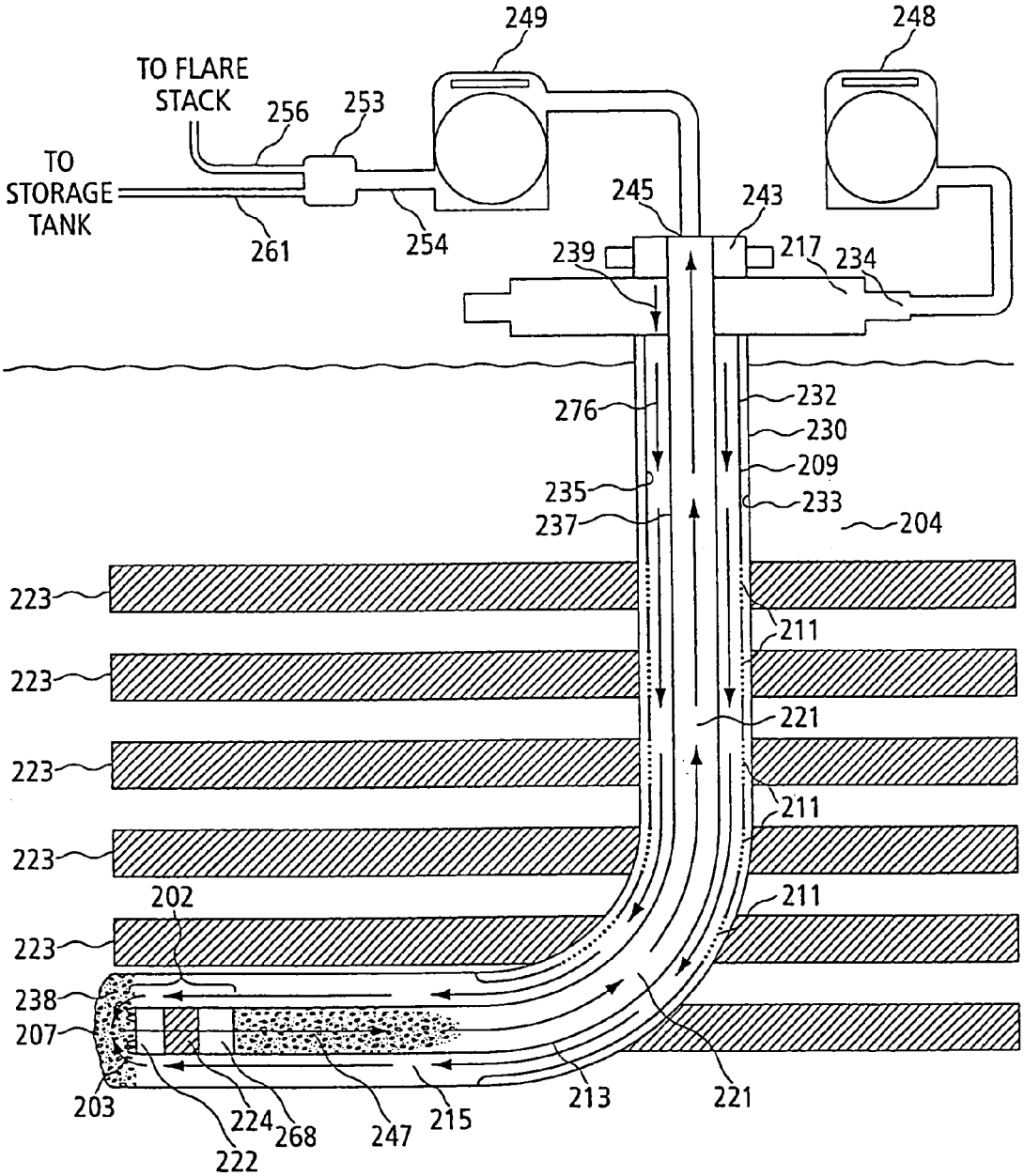
FIG. 10 is a general view showing a partial cross-section of the apparatus and method of the present invention using production tubing as it is located in a clean out operation.

Another preferred embodiment of the present invention is shown in FIG. 10. FIG. 10 shows a well bore 230 which has been cased in by casing 209. Casing 209 comprises a plurality of casing perforations 211 located at the various production zones 223 of the formation. In this embodiment, the horizontal leg of the well is not cased. The clean out apparatus 204 of this embodiment comprises production tubing 213 which may be left permanently in the well bore 230 or it can be simply used for clean out and pulled from the well once clean out has been completed. In another embodiment, coiled tubing can replace jointed production tubing. Coiled tubing can also be left permanently in the well bore or it can be simply used for clean out and pulled from the well once clean out has been completed. Well casing 209 is cemented in place by forcing cement between the well bore inner wall 233 and the outer wall 232 of casing 209.

Production tubing 213 is inserted inside casing 209 and the bare horizontal legg of the well bore and can either be used alone for clean out or can further comprise clean out tool 202. Clean out tool 202 comprises clean out spear 222 having a plurality of impact teeth 203 at its lower end to move clean out materials 238 located at or near the well bore bottom 207. Clean out spear 222 is connected to a reciprocating piston 224 moving within piston casing (not shown). When coiled tubing is used, the clean out apparatus 204 can further comprise a rotation means attached to the reciprocating clean out tool.

The diameter of the well casing 209 and production tubing 213 can vary depending upon the production from the well. Typically, well casing is approximately 4.5 inches in diameter and production tubing is between 2 and 3 inches in diameter. An outer annulus 215 is formed between the inner wall 235 of the casing 209 and the outer wall 237 of production tubing 213. At the top of the well there can be a casing bowl 217 and a wellhead 243.

Clean out apparatus 204 of the present invention further comprises discharge compressor 249 and suction compressor 248. Discharge compressor 249 produces a high volume of low pressure clean out medium 276, for example, compressed air, which is directed down outer annulus 215 through pathway 239 in the casing bowl 217. In the alternative, wellhead 243 can also be used as a pathway to the outer annulus 215. It is understood that when drilling mud or drilling fluid is used as the clean out medium, discharge compressor 249 can be replaced with a mud pump.

When using compressed air as the clean out medium, the flow of air is typically around 1600 cfm and the pressure is typically around 100 psi; however, the flow of air will vary depending upon the well conditions and formation pressure. Thus, the air pressure is preferably substantially equal to or less than the formation pressure, but sufficient to drive the volume of air to the bottom of the well bore where it mixes With clean out material 238 comprised of fracturing sand, fluids, and the like, which needs to be evacuated from the well bore to the surface. This clean out material 238 is pushed out of the various production zones 223 by the formation pressure and accumulate at the bottom 207 of well bore 230.

Clean out material 238 and exhausted clean out medium 247 will be discharged through the inner space 221 of production tubing 213 as a result of the formation pressure and the clean out medium flow rate and pressure. However, formation pressure and the pressure of the compressed air may not be sufficient to carry clean out material 238 to the surface of the well bore, particularly in low or under balanced wells. Therefore, suction compressor 249 is connected to wellhead 243 to create a suction over the mouth 245 of production tubing 213. Thus, suction compressor 249 assists discharge compressor 248 in drawing all the clean out material 238 through inner space 221 of production tubing 213.

In the alternative, clean out material can be introduced into the inner space 221 of production tubing 213 by means of a discharge compressor or mud pump and the clean out material 238 can be removed through the outer annulus 215 by means of a suction compressor to the surface of a well bore. In this case, the discharge compressor or mud pump would be operably connected near the top of the coiled tubing and the suction compressor would be operably connected near the top of the outer annulus of the well bore.

As previously mentioned, clean out material can vary from fracturing sand and fluid, acid, shale, water, etc. in addition to hydrocarbons produced from the producing zones. Thus, connected to suction compressor 249 is discharge line 254, which carries the exhausted clean out medium, clean out material and hydrocarbons produced from the well bore to separator 253 where the clean out material is separated from the hydrocarbons. The separated clean out material is then transported through storage line 261 and deposited either in a pit or a storage tank (not shown). The separated gaseous hydrocarbons are transported via blewie line 256 and are flared through flare stack by means of propane torch to atmosphere (not shown).

When necessary, clean out apparatus as shown in FIG. 10 further comprises a downhole flow control means 268, or downhole blowout preventor, located at or near the bottom of production tubing 213. The downhole flow control means as shown in FIG. 5 is preferably used for safety purposes when the production tubing 213 is being used for clean out purposes only. The downhole flow control means 268 allows the production tubing to be tripped out of the well without hydrocarbons flowing uncontrolled through the inner space 221 to the surface of the well bore. When tripping out the production tubing, both flow paths 78 and 80 of downhole flow control means in FIG. 5 should be closed off. Other valve means which can shut off the flow through the inner space 221 are known in the art and can be used in the present embodiment.

Figure 11:
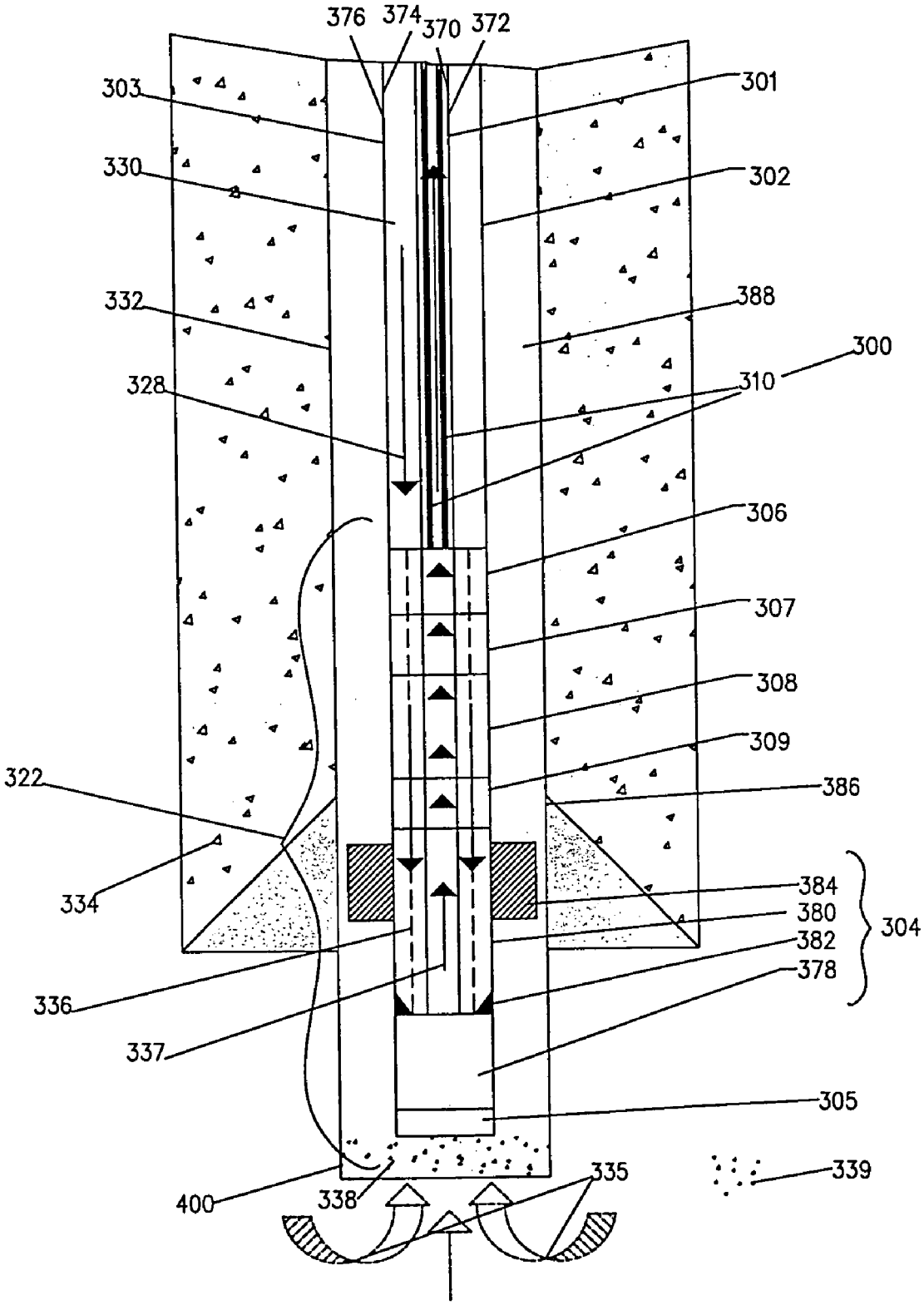
FIG. 11 is a vertical cross-section of a clean out apparatus comprising concentric coiled tubing string.

FIG. 11 is a vertical cross-section of a bottom portion of another preferred embodiment of the present invention which uses coiled in coiled tubing. FIG. 11 shows clean out apparatus 300 having been delivered into well bore 332. At or near the bottom 400 of said well bore 332 is situated clean out material 338 comprising sand, shale, drill cuttings, drilling fluid and the like, which when removed increases the productivity of well bore 332.

Clean out apparatus 300 comprises concentric coiled tubing string 303. Concentric coiled tubing string 303 comprises an inner coiled tubing string 301 having an inside wall 370 and an outside wall 372 and an outer coiled tubing string 302 having an inside wall 374 and an outside wall 376. The inner coiled tubing string 301 is inserted inside the outer coiled tubing string 302. The outer coiled tubing string 302 typically has an outer diameter of 73.0 mm or 88.9 mm, and the inner coiled tubing string 301 typically has an outer diameter of 38.1 mm, 44.5 mm, or 50.8 mm. Other diameters of either string may be run as deemed necessary for the clean out operation. Concentric coiled tubing string annulus 330 is formed between the outside wall 372 of the inner coiled tubing string 301 and the inside wall 374 of the outer coiled tubing string 302.

Figure 12:
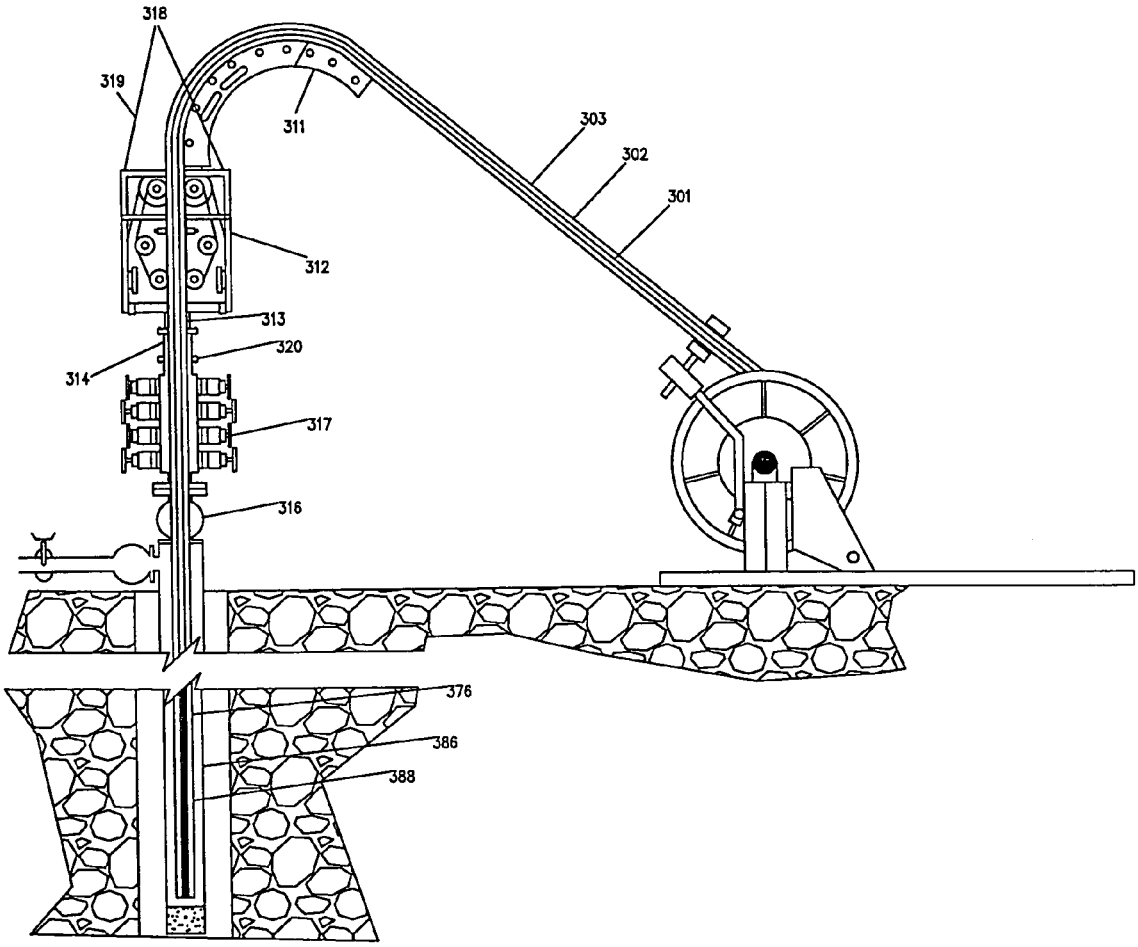
FIG. 12 is a general view showing a partial cross-section of the apparatus and method of the present invention using concentric coiled tubing string as it is located in a clean out operation.

Clean out apparatus 300 further comprises bottom hole assembly 322 attached to the bottom of concentric coiled tubing drill string 303 by means of concentric coiled tubing connector 306. It should be understood, however, that the present embodiment could also operate without bottom hole assembly 322 in much the same fashion as described for the clean out apparatus in FIG. 1. This is shown in FIG. 12.

Bottom hole assembly 322 comprises clean out tool 304, which is in fluid communication with both the concentric coiled tubing string annulus 330 and the inside of inner coiled tubing string 301. Clean out tool 304 further comprises clean out spear 378 having a plurality of impact teeth 305. Clean out spear 378 is connected to a reciprocating piston 380 housed in a piston casing for moving the clean out spear 378 up and down to aid in moving clean out material 338 located at or near the well bore bottom 400. In a preferred embodiment, bottom hole assembly 322 further comprises a downhole blowout preventor or flow control means 307, disconnecting means 308, and rotating sub 309.

Rotating sub 309 rotates the clean out tool 304 to ensure that clean out spear 378 doesn't move up and down at only one spot in the well bore. Disconnecting means 308 provides a means for disconnecting concentric coiled tubing string 303 from the clean out tool 304 should it get stuck in the well bore. Downhole flow control means 307 enables flow from the well bore to be shut off through either or both of the inner coiled tubing string 301 and the concentric coiled tubing string annulus 330 between the inner coiled tubing string 301 and the outer coiled tubing string 302. Concentric coiled tubing connector 306 connects outer coiled tubing string 302 and inner coiled tubing string 301 to the bottom hole assembly 322. It should be noted, however, that outer coiled tubing string 302 and inner coiled tubing string 301 could be directly connected to clean out tool 304.

Flow control means 307 operates by means of two small diameter capillary tubes 310 that are run inside inner coiled tubing string 301 and connect to downhole flow control means 307. Hydraulic or pneumatic pressure is transmitted through capillary tubes 310 from surface. Capillary tubes 310 are typically stainless steel of 6.4 mm diameter, but may be of varying material and of smaller or larger diameter as required.

Clean out medium 328 is pumped through concentric coiled tubing string annulus 30 by means of discharge compressor 321 (in the case of compressed air and the like) or mud pump 323 (in the case of drilling mud or drilling fluid),as shown in FIG. 13, into a flow path 336 in the reverse-circulating clean out tool 304, while maintaining isolation from the inside of the inner coiled tubing string 301. The clean out medium 328 powers the reverse-circulating clean out tool 304, which cleans the well bore of clean out material 338 such as fracturing sand, acid, fluid, shale, cement and the like without damaging the hydrocarbon formation 334.

Exhaust clean out medium 335 from the reverse-circulating clean out tool 304 is, in whole or in part, drawn back up inside the reverse-circulating clean out tool 304 through a flow path 337 which is isolated from the clean out medium 328 and the flow path 336. Along with exhaust clean out medium 335, clean out material 338 and formation fluids 339 are also, in whole or in part, drawn back up inside the reverse-circulating clean out tool 304 and into flow path 337. Venturi 382 aids in accelerating exhaust clean out medium 335 to ensure that clean out material 338 is removed from well bore bottom 400. In a preferred embodiment, shroud 384 is located between reciprocating piston 380 and inner wall 386 of well bore 332 in relatively air tight and frictional engagement with the inner wall 386. Shroud 384 reduces the potential for exhaust clean out medium 335 and clean out material 338 from escaping up the well bore annulus 388 between the outside wall 376 of outer coiled tubing string 302 and the inside wall 386 of well bore 332 so that the exhaust clean out medium 335, clean out material 338, and formation fluids 339 preferentially flow up the inner coiled tubing string 301. Exhaust clean out medium 335, clean out material 338, and formation fluids 339 from flow path 337 are pushed to surface under formation pressure and/or with the assistance of suction compressor 341 as shown in FIG. 13.

In another embodiment of the present invention, clean out medium can be pumped down inner coiled tubing string 301 and exhaust clean out medium carried to the surface of the well bore through concentric coiled tubing string annulus 330. Reverse circulation of the present invention can use as a clean out medium air, drilling mud or drilling fluids or a combination of drilling fluid and gases such as nitrogen and air. Discharge compressor 321 (see FIG. 13) is preferably set at a pressure substantially equal to or lower than the formation pressure. This will help prevent clean out medium 328 from being pushed, together with the clean out material 338, into hydrocarbon formation 334. If clean out medium used is drilling mud or drilling fluid, mud pump 323 (see FIG. 13) is also preferably set at a pressure substantially equal to or lower than the formation pressure.

FIG. 12 shows another preferred embodiment of the present method and apparatus using concentric coiled tubing for safely cleaning out a natural gas well or any well containing hydrocarbons using concentric coiled tubing clean out apparatus. Concentric coiled tubing string 303 is run over a gooseneck or arch device 311 and stabbed into and through an injector device 312. Arch device 311 serves to bend concentric coiled tubing string 303 into injector device 312, which serves to push the concentric coiled tubing string into the well bore, or pull the concentric coiled tubing string 303 from the well bore as necessary to conduct the operation. Concentric coiled tubing string 303 is pushed or pulled through a stuffing box assembly 313 and into a lubricator assembly 314. Stuffing box assembly 313 serves to contain well bore pressure and fluids, and lubricator assembly 314 allows for a length of coiled tubing or bottomhole assembly 322 to be lifted above the well bore and allowing the well bore to be closed off from pressure.

The preferred embodiment in FIG. 12 uses concentric coiled tubing string without a bottomhole assembly connected at the bottom. Preferably, a downhole flow control means would be attached at or near the bottom of the concentric coiled tubing string for safety purposes. Typically, downhole flow control means would first be tested to ensure it is capable of closing from surface actuated controls (not shown) and containing well bore pressure without leaks before the concentric coiled tubing string is lowered into the well.

However, a bottom hole assembly such as depicted in FIG. 11 could also be connected to the concentric coiled tubing string 303. Typical steps would be for the bottom hole assembly to be pulled into lubricator assembly 314. Lubricator assembly 314 is manipulated in an upright position directly above the wellhead 316 and surface blowout preventor 317 by means of crane 318 with a cable and hook assembly 319. Lubricator assembly 314 is attached to surface blowout preventor 317 by a quick-connect union 320. Lubricator assembly 314, stuffing box assembly 313, and surface blowout preventor 317 are pressure tested to ensure they are all capable of containing expected well bore pressures without leaks.

Surface blowout preventor 317 is used to prevent a sudden or uncontrolled flow of hydrocarbons from escaping from the well bore annulus 388 between the inner well bore wall 386 and the outside wall 376 of the outer coiled tubing string 302 during the clean out operation. An example of such a blowout preventor is Texas Oil Tools Model #EG72-T004. Surface blowout preventor 317 is not equipped to control hydrocarbons flowing up the inside of concentric coiled tubing drill string, however.

FIG. 13 is a schematic drawing of the operations used for the removal of exhaust clean out medium and clean out material out of the well bore. Suction compressor 341 or similar device may be placed downstream of the outlet rotating joint 340 to maintain sufficient fluid velocity inside the inner coiled tubing string 301 to keep all solids moving upwards and flowed through outlet rotating joint 340. This is especially important when there is insufficient formation pressure to move exhaust clean out medium 335, clean out material 338, and formation fluids 339 up the inner space of the inner coiled tubing string 301. Outlet rotating joint 340 allows exhaust clean out medium 335, clean out material 338, and formation fluids 339 to be discharged from the inner space of inner coiled tubing string 301 while maintaining pressure control from the inner space, without leaks to atmosphere or to concentric coiled tubing string annulus 330 while moving the concentric coiled tubing string 303 into or out of the well bore.

Upon completion of pressure testing, wellhead 316 is opened and concentric coiled tubing string 303 and bottom hole assembly 322 (if used) are pushed into the well bore by the injector device 312. A hydraulic pump 323 (commonly called a mud pump) may pump drilling mud or drilling fluid 324 from a storage tank 325 into a flow line T-junction 326 when drilling mud or drilling fluid is used as the clean out medium. In the alternative, or in combination, discharge compressor 321 may also pump air or nitrogen 327 into a flow line to T-junction 326. Therefore, clean out medium 328 can consist of drilling mud or drilling fluid 324, gas 327, or a commingled stream of drilling fluid 324 and gas 327 as required for the operation.

Clean out medium 328 is pumped into the inlet rotating joint 329 which directs clean out medium 328 into concentric coiled tubing string annulus 330 between inner coiled tubing string 301 and outer coiled tubing string 302. Inlet rotating joint 329 allows clean out medium 328 to be pumped into concentric coiled tubing string annulus 330 while maintaining pressure control from concentric coiled tubing string annulus 330, without leaks to atmosphere or to inner coiled tubing string 301, while moving concentric coiled tubing string 303 into or out of the well bore.

Exhaust clean out medium 335, clean out material 338, and formation fluids 339 flow from the outlet rotating joint 340 through a plurality of piping and valves 342 to a surface separation system 343. Surface separation system 343 may comprise a length of straight piping terminating at an open tank or earthen pit, or may comprise a pressure vessel capable of separating and measuring liquid, gas, and solids. Exhaust clean out medium 335, clean out material 338, and formation fluids 339, including hydrocarbons, that are not drawn into the reverse-circulation clean out assembly may flow up the well bore annulus 388 between the outside wall 376 of outer coiled tubing string 302 and the inside wall 386 of well bore 332. Materials flowing up the well bore annulus 388 will flow through wellhead 316 and surface blowout preventor 317 and be directed from the surface blowout preventor 317 to surface separation system 343. Separated gaseous hydrocarbons are transported via blewie line 362 and are flared through flare stack 364 by means of propane torch (not shown) to atmosphere.

Figure 14A:
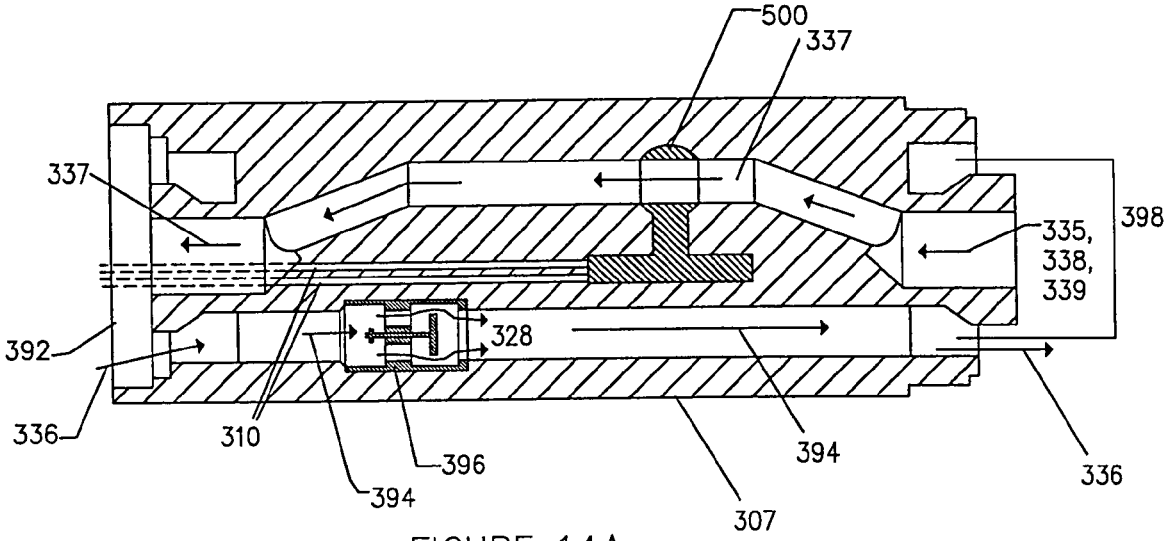
FIG. 14*a* shows a vertical cross-section of a downhole flow control means in the open position for use with concentric coiled tubing string.
Figure 14B:
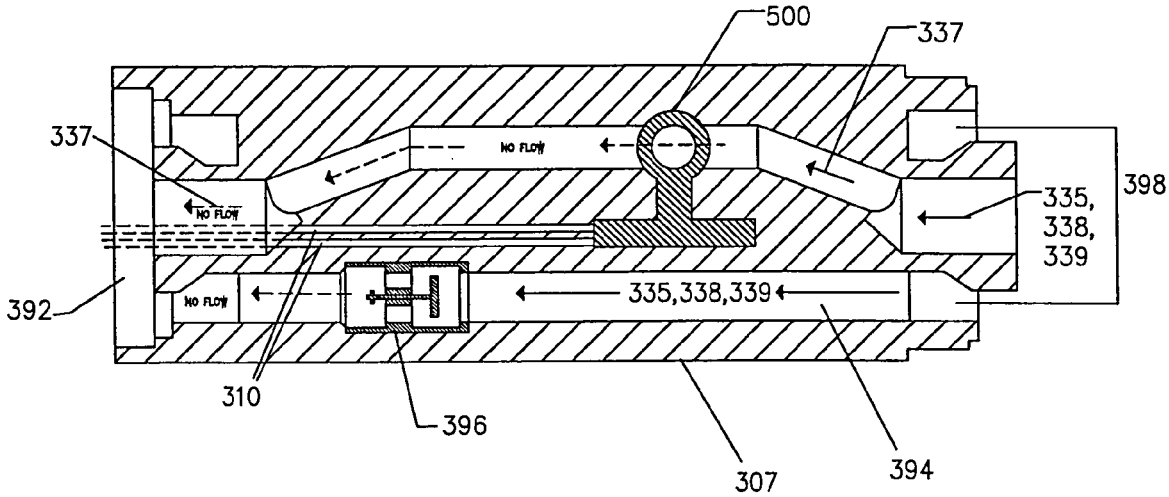
FIG. 14*b* shows a vertical cross-section of a downhole flow control means of FIG. 14*a* in the closed position.

FIG. 14*a* is a vertical cross-section of downhole flow control means 307 in open position and FIG. 14*b* is a vertical cross-section of downhole flow control means 307 in closed position. Downhole flow control means 307 may be required within bottom hole assembly 322 or when using concentric coiled tubing alone to enable flow from the well bore to be shut off through either or both of the inner coiled tubing string 301 or the concentric coiled tubing string annulus 330. For effective well control, the downhole flow control means should be capable of being operated from surface by a means independent of the well bore conditions, or in response to an overpressure situation from the well bore.

Referring first to FIG. 14*a,* the downhole flow control means 307 allows clean out medium 328 to flow through annular flow path 336. Clean out medium from the annular flow path 336 is directed to first diffuser sub 392 that takes the annular flow path 336 and channels it into single monobore flow path 394. Clean out medium 328 flows through single monobore flow path 394 and through a check valve means 396 which allows flow in the intended direction, but operates under a spring mechanism to stop flow from reversing direction and traveling back up the annular flow path 336 or the single monobore flow path 394. Downstream of check valve means 396 single monobore flow path 394 is directed through second diffuser sub 398 which re-directs flow from single monobore flow path 394 back to annular flow path 336. When operated in the open position, exhaust clean out medium 335, clean out material 338 and formation fluid 339, including hydrocarbons, flow up through inner coiled tubing flow path 337. Inner coiled tubing flow path 337 passes through hydraulically operated ball valve 500 that allows full, unobstructed flow when operated in the open position.

Referring now to FIG. 14*b,* downhole flow control means 307 is shown in the closed position. To provide well control from inner coiled tubing flow path 337, hydraulic pressure is applied at pump 347 to one of capillary tubes 310. This causes ball valve 500 to close thereby closing off inner coiled tubing flow path 337 and preventing uncontrolled flow of formation fluids or gas through the inner coiled tubing string 301. In the event of an overpressure situation in single monobore flow path 394, check valve 396 closes with the reversed flow and prevents reverse flow through single monobore flow path 394. In this embodiment, well bore flow is thus prohibited from flowing up annular flow path 336 or single monobore flow path 394 in the event formation pressure exceeds pumping pressure, thereby providing well control in the annular flow path 336.

An optional feature of downhole flow control means 307 would allow communication between single monobore flow path 394 and inner coiled tubing flow path 337 when the downhole flow control means is operated in the closed position. This would allow continued circulation down annular flow path 336 and back up inner coiled tubing flow path 337 without being open to the well bore.

Figure 15:
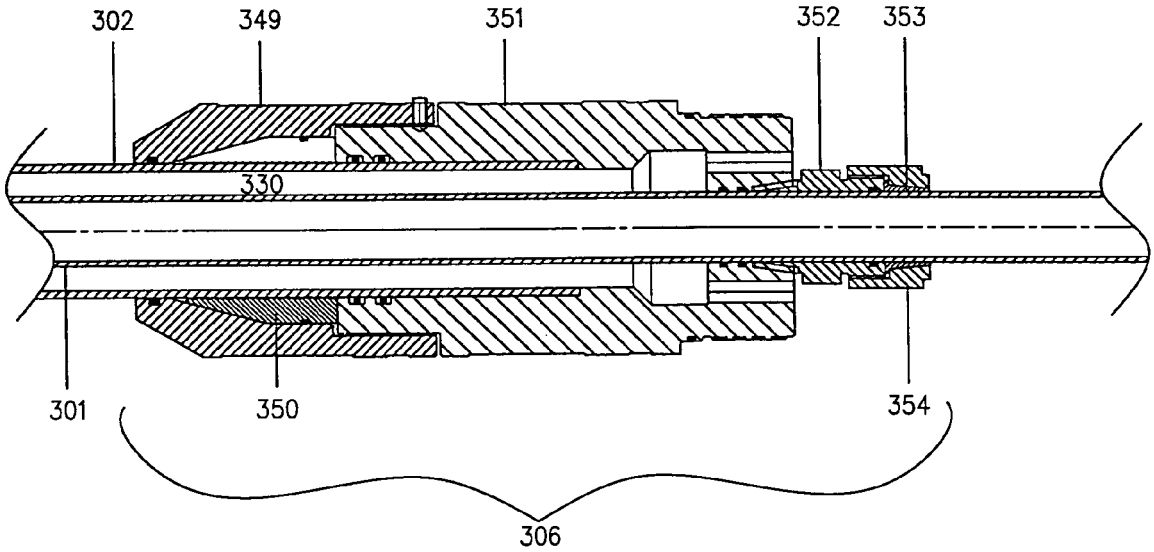
FIG. 15 shows a vertical cross-section of a concentric coiled tubing connector.

FIG. 15 is a vertical cross-section of concentric coiled tubing connector 306. Both outer coiled tubing string 302 and the inner coiled tubing string 301 can be connected to bottom hole assembly 322 by means of concentric coiled tubing connector 306. First connector cap 349 is placed over outer coiled tubing string 302. First external slip rings 350 are placed inside first connector cap 349, and are compressed onto outer coiled tubing string 302 by first connector sub 351, which is threaded into first connector cap 349. Inner coiled tubing string 301 is extended through the bottom of first connector sub 351, and second connector cap 352 is placed over inner coiled tubing string 301 and threaded into first connector sub 351. Second external slip rings 353 are placed inside second connector cap 352, and are compressed onto inner coiled tubing string 301 by second connector sub 354, which is threaded into second connector cap 352. First connector sub 351 is ported to allow flow through the sub body from concentric coiled tubing string annulus 330.

Figure 16:
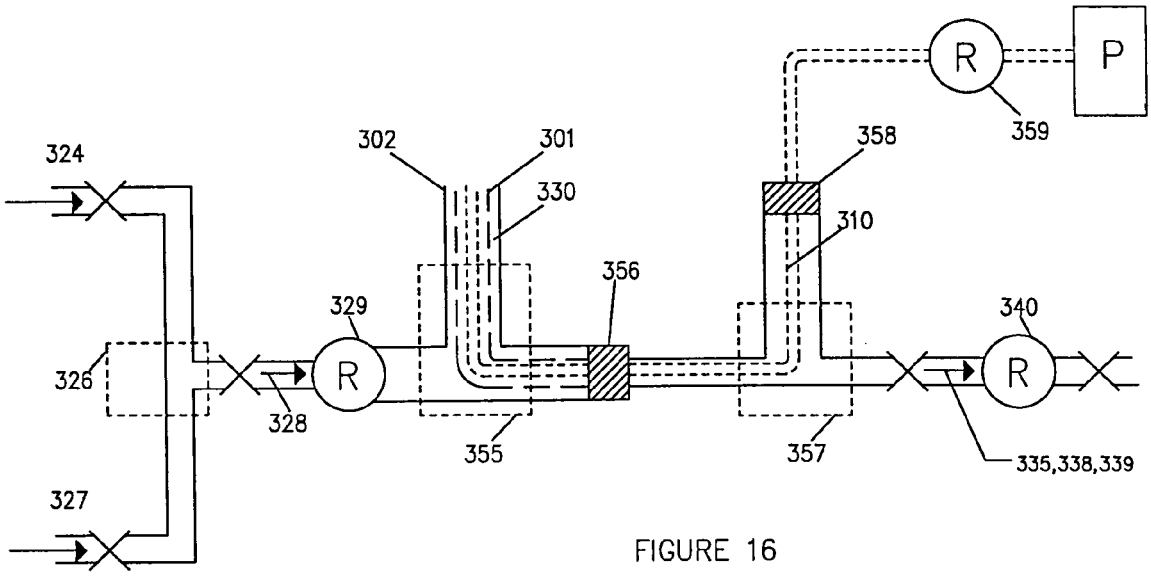
FIG. 16 is a schematic drawing of a concentric coiled tubing bulkhead assembly.

FIG. 16 is a schematic diagram of a coiled tubing bulkhead assembly. Clean out medium 328 is pumped into rotary joint 329 to first coiled tubing bulkhead 355, which is connected to the concentric coiled tubing drill string 303 by way of outer coiled tubing string 302 and ultimately feeds concentric coiled tubing string annulus 330. First coiled tubing bulkhead 355 is also connected to inner coiled tubing string 301 such that flow from the inner coiled tubing string 301 is isolated from concentric coiled tubing string annulus 330. Inner coiled tubing string 301 is run through a first packoff device 356 which removes it from contact with concentric coiled tubing string annulus 330 and connects it to second coiled tubing bulkhead 357. Flow from inner coiled tubing string 301 flows through second coiled tubing bulkhead 357, through a series of valves, and ultimately to outlet rotary joint 340, which permits flow from inner coiled tubing string 301 under pressure while the concentric coiled tubing string 303 is moved into or out of the well. Flow from inner coiled tubing string 301, which comprises exhaust clean out medium 335, clean out material 338 and formation fluid 339, including hydrocarbons, is therefore allowed through outlet rotary joint 340 and allowed to discharge to the surface separation system.

An additional feature of second coiled tubing bulkhead 357 is that it provides for the insertion of one or more smaller diameter tubes or devices, with pressure control, into the inner coiled tubing string 301 through second packoff 358. In the preferred embodiment, second packoff 358 provides for two capillary tubes 310 to be run inside the inner coiled tubing string 301 for the operation and control of downhole flow control means 307. The capillary tubes 310 are connected to a third rotating joint 359, allowing pressure control of the capillary tubes 310 while rotating the work reel.

While various embodiments in accordance with the present invention have been shown and described, it is understood that the same is not limited thereto, but is susceptible of numerous changes and modifications as known to those skilled in the art, and therefore the present invention is not to be limited to the details shown and described herein, but intend to cover all such changes and modifications as are encompassed by the scope of the appended claims.

I claim:

1. A method for removing material from a well bore extending from a ground surface into a hydrocarbon formation having a pressure, comprising:

(a) delivering into said well bore a concentric drill pipe string, said concentric drill pipe string comprising an inner pipe having an inner space therethrough and an outer pipe forming an outer annulus between said outer pipe and said inner pipe;

(b) introducing into said well bore at a pressure substantially equal to or below said pressure of the formation a pressurized clean out medium through one of the said inner space and outer annulus; and (c) removing said material and clean out medium through the other of the said inner space and said outer annulus to the surface of said well bore by means of a suctioning means in operable communication with the other of the said inner space and said outer space.

2. The method of claim 1 wherein said material comprises one or more of solid particles, sediment, injection fluids, fracturing acids, sands, and drilling fluids.

3. The method of claim 1 wherein said clean out medium is selected from the group consisting of drilling mud, drilling fluid, air, gas, acids and a mixture of drilling fluid and gas.

4. The method of claim 1, wherein said pressurized clean out medium is introduced by a discharging means in operable communication with one of the said inner space or said outer annulus.

5. The method of claim 4 wherein said discharging means comprises a mud pump.

6. The method of claim 4 wherein said discharging means comprises a discharging compressor.

7. The method of claim 1 wherein said suctioning means comprises a suction compressor.

8. The method of claim 1, said concentric drill pipe string having a top and a bottom, further comprising providing a downhole flow control means at or near the bottom of said concentric drill pipe string for preventing flow of hydrocarbon from the inner space, the outer annulus or both to the surface of the well bore.

9. The method of claim 8 further comprising controlling said downhole flow control means at the surface of said well bore by a surface control means.

10. The method of claim 9 wherein said surface control means controls said downhole flow control means by transmitting a signal selected from the group consisting of an electric signal, a hydraulic signal, a pneumatic signal, a light signal or a radio signal.

11. The method of claim 1 wherein said pressurized clean out medium is introduced into said well bore through the outer annulus and said material and said clean out medium is removed through the inner space.

12. The method of claim 1 further comprising providing a surface flow control means positioned at or near the surface of the well bore for preventing flow of hydrocarbon from a space between an outside wall of said outer pipe and a wall of said well bore.

13. The method of claim 1 comprising flaring hydrocarbon produced from the well bore by means of a flare means.

14. The method of claim 1 further comprising providing a venturi for accelerating said clean out medium so as to facilitate removal of said material to the surface of said well bore.

15. The method of claim 1 wherein said well bore further comprises a casing means having a plurality of perforations.

16. A method for removing material from a well bore extending from a ground surface into a hydrocarbon formation having a pressure, comprising:

(a) delivering into said well bore a concentric drill pine string, said concentric drill pipe string having a top and bottom and comprising an inner pipe having an inner space therethrough and an outer pipe forming an outer annulus between said outer pipe and said inner pine;

(b) introducing into said well bore at a pressure substantially equal to or below said pressure of the formation a pressurized clean out medium through one of the said inner space and outer annulus;

(c) providing a reciprocating clean out tool at or near the bottom of said concentric drill pipe string for disturbing said material in said well bore; and (d) removing said material and clean out medium through the other of the said inner space and said outer annulus to the surface of said well bore.

17. The method of claim 16 wherein said reciprocating clean out tool further comprises a clean out means having a plurality of teeth and a reciprocating piston.

18. A method for removing material from a well bore extending from a ground surface into a hydrocarbon formation having a pressure, comprising:

(a) delivering into said well bore a concentric drill pipe string, said concentric drill pipe string comprising an inner pipe having an inner space therethrough and an outer pipe forming an outer annulus between said outer pipe and said inner pipe;

(b) introducing into said well bore at a pressure substantially equal to or below said pressure of the formation a pressurized clean out medium through the inner space; and (c) removing said material and said clean out medium through the outer annulus to the surface of said well bore.

19. A method for removing material from a well bore extending from a ground surface into a hydrocarbon formation having a pressure, comprising:

(a) delivering into said well bore a concentric drill pipe string, said concentric drill pipe string comprising an inner pipe having an inner space therethrough and an outer pipe forming an outer annulus between said outer pipe and said inner pipe;

(b) introducing into said well bore at a pressure substantially equal to or below said pressure of the formation a pressurized clean out medium through one of the said inner space and outer annulus;

(c) removing said material and clean out medium through the other of the said inner space and said outer annulus to the surface of said well bore; and (d) providing a shroud means positioned in a space between an outside wall of said outer pipe and a wall of said well bore for preventing a release of clean out medium or material or both in said space.

20. An apparatus for removing material from a well bore extending from a ground surface into a hydrocarbon formation having a pressure, comprising;

(a) a concentric tubing string, said concentric tubing string comprising an inner tube means having an inner space therethrough and an outer tube means forming an outer annulus between said outer tube means and said inner tube means;

(b) means for introducing into said well bore a pressurized clean out medium trough one of the said inner space and outer annulus;

(c) means for removing said material and clean out medium through the other of the said inner space and said outer annulus to the surface of said well bore; and (d) a surface flow control means positioned at or near the surface of the well bore for preventing flow of hydrocarbon from a space between an outside wall of said outer tube means and a wall of said well bore.

21. The apparatus of claim 20 wherein said concentric tubing string is a concentric drill pipe string.

22. The apparatus of claim 20 wherein said concentric tubing string is a concentric coiled tubing string.

23. The apparatus of claim 22 further comprising a bottom hole assembly.

24. The apparatus of claim 23 wherein said bottom hole assembly comprises a reciprocating clean out tool.

25. The apparatus of claim 24 wherein said bottom hole assembly further comprises a rotation means attached to said reciprocating clean out tool.

26. The apparatus of claim 25 further comprising a connecting means for connecting said outer tube means and said inner tube means to said reciprocating clean out tool thereby centering said inner tube means within said outer tube means.

27. The apparatus of claim 26 further comprising a disconnecting means located between said connecting means and said reciprocating clean out tool for disconnecting said reciprocating clean out tool from said concentric coiled tubing string.

28. The apparatus of claim 20, said concentric tubing string having a top and a bottom, wherein said introducing means is operably connected near the top of said concentric tubing string in communication with either said inner space or said outer annulus.

29. The apparatus of claim 20 wherein said introducing means comprises a mud pump.

30. The apparatus of claim 20 wherein said introducing means comprises a discharging compressor.

31. The apparatus of claim 20, said concentric tubing string having a top and a bottom, wherein said removing means is operably connected near the top of said concentric tubing string in communication with either said inner space or said outer annulus.

32. The apparatus of claim 31 wherein said removing means comprises a suctioning compressor.

33. The apparatus of claim 20, said concentric tubing string having a top and a bottom, further comprising a downhole flow control means at or near the bottom of said concentric tubing string for preventing flow of hydrocarbon from the inner space, the outer annulus or both to the surface of the well bore.

34. The apparatus of claim 33 further comprising a surface control means for controlling said downhole flow control means at the surface of said well bore.

35. The apparatus of claim 34 wherein said surface control means transmits a signal selected from the group consisting of an electric signal, a hydraulic signal, a pneumatic signal, a light signal or a radio signal.

36. The apparatus of claim 20, said concentric tubing string having a top and a bottom, further comprising a clean out tool at or near the bottom of said concentric tubing string for disturbing said material in said well bore.

37. The apparatus of claim 36 wherein said clean out tool is a reciprocating clean out tool.

38. The apparatus of claim 37 wherein said clean out tool further comprises a clean out means having a plurality of teeth and a reciprocating piston.

39. The apparatus of claim 36 wherein said clean out tool further comprises a diverter means to facilitate removal of clean out medium from the concentric tubing string.

40. The apparatus of claim 39 wherein said diverter means comprises a venturi.

41. The apparatus of claim 20 wherein said removing means further comprises a flare means for flaring hydrocarbon produced from the well bore.

42. The apparatus of claim 20 further comprising a shroud means positioned in a space between an outside wall of said outer tube means and a wall of said well bore for preventing a release of clean our medium or material or both in said space or into said hydrocarbon formation or both.

43. The apparatus of claim 22 further comprising means for storing said concentric coiled tubing siring.

44. The apparatus of claim 43 wherein said storing means comprises a work reel.

45. A method for removing material from a well bore extending from a ground surface into a hydrocarbon formation having a pressure, comprising:

(a) delivering into said well bore a single wall production tubing string, said production tubing string having an inner space and an outer wall and forming an annulus between the outer wall of said production tubing string and a wall of said well bore;

(b) introducing into said well bore at a pressure substantially equal to or below said pressure of the formation a pressurized clean out medium through said annulus; and (c) removing said material and clean out medium through the inner space of said production tubing string to the surface of said well bore.

46. The method of claim 45 wherein said wall of said well bore further comprises a casing having a plurality of perforations.

47. The method of claim 45 wherein said production tubing string is a coiled tubing string.

48. The method of claim 45 wherein said production tubing string is a drill pipe string.

49. The method of claim 45 wherein said material comprises one or more of solid particles, sediment, injection fluids, fracturing acids, sands, and drilling fluids.

50. The method of claim 45 wherein said clean out medium is selected from the group consisting of drilling mud, drilling fluid, air, gas, acids and a mixture of drilling fluid and gas.

51. The method of claim 45, said production tubing string having a top and a bottom, wherein said pressurized clean out medium is introduced by a discharging means operably connected near the top of said production tubing string in communication with said annulus formed between said outer wall of said production tubing string and said wall of said well bore.

52. The method of claim 51 wherein said well bore further comprises a casing having a plurality of perforations.

53. The method of claim 51 wherein said discharging means comprises a mud pump.

54. The method of claim 51 wherein said discharging means comprises a discharging compressor.

55. The method of claim 45, said production tubing string having a top and a bottom, wherein said material and said clean out medium is removed by a suctioning means operably connected near the top of said production tubing string in communication with said inner space of said production tubing string.

56. The method of claim 55 wherein said suctioning means comprises a suction compressor.

57. The method of claim 45, said production tubing string having a top and a bottom, further comprising providing a downhole flow control means at or near the bottom of said production tubing string for preventing flow of hydrocarbon from the inner space of said production tubing string to the surface of the well bore.

58. The method of claim 57 further comprising controlling said downhole flow control means at the surface of said well bore by a surface control means.

59. The method of claim 58 wherein said surface control means controls said downhole flow control means by transmitting a signal selected from the group consisting of an electric signal, a hydraulic signal, a pneumatic signal, a light signal or a radio signal.

60. The method of claim 45 further comprising providing a surface flow control means positioned at or near the surface of the well bore for preventing flow of hydrocarbon from the annulus between the outer wall of said production tubing string and the wall of said well bore.

61. The method of claim 45 comprising flaring hydrocarbon produced from the well bore by means of a flare means.

62. A method for removing material from a well bore extending from a ground surface into a hydrocarbon formation having a pressure, comprising:

(a) delivering into said well bore a single wall production tubing string, said production tubing string having a top and a bottom, further having an inner space and an outer wall and forming an annulus between the outer wall of said production tubing string and a wall of said well bore;

(b) introducing into said well bore a pressurized clean out medium through said annulus;

(c) providing a reciprocating clean out tool at or near the bottom of said production tubing string for disturbing said material in said well bore; and (d) removing said material and clean out medium through the inner space of said production tubing string to the surface of said well bore.

63. The method of claim 62 wherein said reciprocating clean out tool further comprises a clean out means having a plurality of teeth and a reciprocating piston.

64. An apparatus for removing material from a well bore extending from a ground surface into a hydrocarbon formation having a pressure, comprising:

(a) a single wall production tubing string, said production tubing string having a top and bottom, further having an inner space and an outer wall and forming an annulus between the outer wall of said production tubing string and a wall of said well bore;

(b) means communicating with said annulus for introducing into said well bore a pressurized clean out medium through said annulus;

(c) means communicating with said inner space for removing said material and clean out medium through said inner space of said production tubing string to the surface of said well bore; and (d) a reciprocating clean out tool at or near the bottom of said production tubing string for disturbing said material in said well bore.

65. The apparatus of claim 64 wherein said production tubing string is a drill pipe string.

66. The apparatus of claim 64 wherein said production tubing string is a coiled tubing string.

67. The apparatus of claim 66 further comprising a rotation means attached to said reciprocating clean out tool.

68. The apparatus of claim 67 further comprising a connecting means for connecting said coiled tubing string to said reciprocating clean out tool.

69. The apparatus of claim 68 further comprising a disconnecting means located between said connecting means and said reciprocating clean out tool for disconnecting said reciprocating clean out tool from said coiled tubing string.

70. The apparatus of claim 66 further comprising means for storing said coiled tubing string.

71. The apparatus of claim 70 wherein said storing means comprises a work reel.

72. The apparatus of claim 64, wherein said introducing means is operably connected near the top of said production tubing string in communication with said annulus formed between said outer wall of said production tubing string and said wall of said well bore.

73. The apparatus of claim 64 wherein said introducing means comprises a mud pump.

74. The apparatus of claim 64 wherein said introducing means comprises a discharging compressor.

75. The apparatus of claim 64, wherein said removing means is operably connected near the top of said production tubing string in communication with said inner space of said production tubing string.

76. The apparatus of claim 75 wherein said removing means comprises a suctioning compressor.

77. The apparatus of claim 64, further comprising a downhole flow control means at or near the bottom of said production tubing string for preventing flow of hydrocarbon from the inner space of said production tubing string to the surface of the well bore.

78. The apparatus of claim 77 further comprising a surface control means for controlling said downhole flow control means at the surface of said well bore.

79. The apparatus of claim 78 wherein said surface control means transmits a signal selected from the group consisting of an electric signal, a hydraulic signal, a pneumatic signal, a light signal or a radio signal.

80. The apparatus of claim 64 wherein said reciprocating clean out tool further comprises a clean out means having a plurality of teeth and a reciprocating piston.

81. The apparatus of claim 64 further comprising a surface flow control means positioned at or near the surface of the well bore for preventing flow of hydrocarbon from the annulus.

82. The apparatus of claim 64 wherein said removing means further comprises a flare means for flaring hydrocarbon produced from the well bore.

83. A method for removing material from a well bore extending from a ground surface into a hydrocarbon formation having a pressure, comprising:

(a) delivering into said well bore a concentric coiled tubing string, said concentric coiled tubing string consisting essentially of an inner coiled tubing string having an inner space therethrough and an outer coiled tubing string, said inner coiled tubing string and said outer coiled tubing string forming an annulus therebetween;

(b) introducing into said well bore a pressurized clean out medium through one of the said inner space and annulus; and (c) removing said material and clean out medium through the other of the said inner space and said annulus to the surface of said well bore.

84. The method of claim 83 wherein said pressurized clean out medium is introduced into said well bore at a pressure substantially equal to or below said pressure of the formation.

85. The method of claim 83 wherein said material comprises one or more of solid particles, sediment, injection fluids, fracturing acids, sands, and drilling fluids.

86. The method of claim 83 wherein said clean out medium is selected from the group consisting of drilling mud, drilling fluid, air, gas, acids and a mixture of drilling fluid and gas.

87. The method of claim 83, said concentric coiled tubing string having a top and a bottom, wherein said pressurized clean out medium is introduced by a discharging means operably connected near the top of said concentric coiled tubing string in communication with either said inner space or said annulus.

88. The method of claim 87 wherein said discharging means comprises a mud pump.

89. The method of claim 87 wherein said discharging means comprises a discharging compressor.

90. The method of claim 83, said concentric coiled tubing string having a top and a bottom, wherein said material and said clean out medium is removed by a suctioning means operably connected near the top of said concentric coiled tubing string in communication with either said inner space or said annulus.

91. The method of claim 90 wherein said sauctioning means comprises a suction compressor.

92. The method of claim 83, said concentric coiled tubing string having a top and a bottom, further comprising providing a downhole flow control means at or near the bottom of said concentric coiled tubing string for preventing flow of hydrocarbon from the inner space, the annulus or both to the surface of the well bore.

93. The method of claim 92 further comprising controlling said downhole flow control means at the surface of said well bore by a surface control means.

94. The method of claim 93 wherein said surface control means controls said downhole flow control means by transmitting a signal selected from the group consisting of an electric signal, a hydraulic signal, a pneumatic signal, a light signal or a radio signal.

95. The method of claim 83, said concentric coiled tubing string having a top and a bottom, further comprising providing a clean out tool at or near the bottom of said concentric coiled tubing string for disturbing said material in said well bore.

96. The method of claim 95 wherein said clean out tool is a reciprocating clean out tool.

97. The method of claim 96 wherein said clean out tool further comprises a clean out means having a plurality of teeth and a reciprocating piston.

98. The method of claim 83 wherein said pressurized clean out medium is introduced into said well bore through the annulus and said material and said clean out medium is removed through the inner space.

99. The method of claim 83 wherein said pressurized clean out medium is introduced into said well bore through the inner space and said material and said clean out medium is removed through the annulus.

100. The method of claim 83 further comprising providing a surface flow control means positioned at or near the surface of the well bore for preventing flow of hydrocarbon from a space between an outside wall of said outer coiled tubing string and a wall of said well bore.

101. The method of claim 83 further comprising flaring hydrocarbon produced from the well bore by means of a flare means.

102. The method of claim 83 further comprising providing a venturi for accelerating said clean out medium so as to facilitate removal of said material to the surface of said well bore.

103. The method of claim 83 further comprising providing a shroud means positioned in a space between an outside wall of said outer coiled tubing string and a wall of said well bore for preventing a release of clean out medium or material or both in said space.

104. The method of claim 83 further comprising providing a shroud means positioned in a space between an outside wall of said outer coiled tubing string and a wall of said well bore for preventing a release of clean out medium or material or both into said hydrocarbon formation.

105. The method of claim 83 wherein say well bore further comprises a casing means having a plurality of perforations.

106. An apparatus for removing material from a well bore extending from a ground surface into a hydrocarbon formation having a pressure, comprising;

(a) a concentric coiled tubing string, said concentric coiled tubing string comprising an inner coiled tubing string having an inner space therethrough and an outer coiled tubing string, said inner coiled tubing string and said outer coiled tubing string forming an annulus therebetween;

(b) means for introducing into said well bore a pressurized clean out medium through one of the said inner space and said annulus; and (c) means for removing said material and clean out medium through the other of the said inner space and said annulus to the surface of said well bore.

107. An apparatus for removing material from a well bore extending from a ground surface into a hydrocarbon formation having a pressure, comprising;

(a) a concentric coiled tubing string, said concentric coiled tubing string consisting essentially of an inner coiled tubing string having an upper end and a lower end and further having an inner space therethrough and an outer coiled tubing string having an upper end and a lower end, said inner coiled tubing string and said outer coiled tubing string forming an annulus therebetween, wherein said lower end of said inner coiled tubing string and said lower end of said outer coiled tubing string are in open communication with one another;

(b) means for introducing into said well bore a pressurized clean out medium through one of the said inner space and said annulus; and (c) means for removing said material and clean out medium through the other of the said inner space and said annulus to the surface of said well bore.

108. The apparatus of claim 106 or 107, said concentric coiled tubing suing having a top and a bottom, wherein said introducing means is operably connected near the top of said concentric coiled tubing string in communication with either said inner space or said annulus.

109. The apparatus of claim 108 wherein said introducing means comprises a mud pump.

110. The apparatus of claim 108 wherein said introducing means comprises a discharging compressor.

111. The apparatus of claim 106 or 107, said concentric coiled tubing string having a top and a bottom, wherein said removing means is operably connected near the top of said concentric coiled tubing string in communication with either said inner space or said annulus.

112. The apparatus of claim 111 wherein said removing means comprises a sauctioning compressor.

113. The apparatus of claim 106 or 107, said concentric coiled tubing string having a top and a bottom, further comprising a downhole flow control means at or near the bottom of said concentric coiled tubing string for preventing flow of hydrocarbon from the inner space, the annulus or both to the surface of the well bore.

114. The apparatus of claim 113 further comprising a surface control means for controlling said downhole flow control means at the surface of said well bore.

115. The apparatus of claim 114 wherein said surface control means transmits a signal selected from the group consisting of an electric signal, a hydraulic signal, a pneumatic signal, a light signal or a radio signal.

116. The apparatus of claim 106 or 107, said concentric coiled tubing string having a top and a bottom, further comprising a clean out tool at or near the bottom of said concentric coiled tubing string for disturbing said material in said well bore.

117. The apparatus of claim 116 wherein said clean out tool is a reciprocating clean out tool.

118. The apparatus of claim 117 wherein said clean out tool further comprises a clean out means having a plurality of teeth and a reciprocating piston.

119. The apparatus of claim 118 wherein said clean out tool further comprises a diverter means to facilitate removal of clean out medium from the concentric coiled tubing string.

120. The apparatus of claim 119 wherein said diverter means comprises a venturi.

121. The apparatus of claim 106 or 107 further comprising a surface flow control means positioned at or near the surface of the well bore for preventing flow of hydrocarbon from a space between an outside wall of said outer coiled tubing string and a wall of said well bore.

122. The apparatus of claim 111 wherein said removing means further comprises a flare means for flaring hydrocarbon produced from the well bore.

123. The apparatus of claim 106 or 107 further comprising a shroud means positioned in a space between an outside wall of said outer coiled tubing string and a wall of said well bore for preventing a release of clean out medium or material or both in said space or into said hydrocarbon formation or both.

124. The apparatus of claim 106 or 107 further comprising a bottom hole assembly.

125. The apparatus of claim 124 wherein said bottom hole assembly comprises a reciprocating clean out tool.

126. The apparatus of claim 125 wherein said bottom hole assembly further comprises a rotation means attached to said reciprocating clean out tool.

127. The apparatus of claim 126 further comprising a connecting means for connecting said outer coiled tubing string and said inner coiled tubing string to said reciprocating clean out tool thereby centering said inner coiled tubing string within said outer coiled tubing string.

128. The apparatus of claim 127 further comprising a disconnecting means located between said connecting means and said reciprocating clean out tool for disconnecting said reciprocating clean out tool from said concentric coiled tubing string.

129. The apparatus of claim 106 or 107 further comprising means for scoring said concentric coiled tubing string.

130. The apparatus of claim 129 wherein said storing means comprises a work reel.

131. A method for removing material from a well bore extending from a ground surface into a hydrocarbon formation having a pressure, comprising:

(a) delivering into said well bore a concentric tubing string, said concentric tubing string comprising an inner tube means having an inner space therethrough and an outer tube means, said inner tube means and said outer tube means forming an annulus therebetween;

(b) introducing into said well bore a pressurized clean out medium through one of the said inner space and said annulus;

(c) removing said material and clean out medium through the other of the said inner space and said annulus to the surface of said well bore; and (d) providing a downhole flow control means at or near the bottom of said concentric tubing string for preventing flow of hydrocarbon from the inner space, the annulus or both to the surface of the well bore.

132. The method of claim 131 further comprising controlling said downhole flow control means at the surface of said well bore by a surface control means.

133. The method of claim 132 wherein said surface control means controls said downhole flow control means by transmitting a signal selected from the group consisting of an electric signal, a hydraulic signal, a pneumatic signal, a light signal or a radio signal.

134. The method of claim 131 wherein said pressurized clean out medium is introduced into said well bore at a pressure substantially equal to or below said pressure of the formation.

135. The method of claim 131 wherein said concentric tubing string is a concentric coiled tubing string.

136. The method of claim 131 wherein said concentric tubing string is a concentric drill pipe string.

137. A method for removing material from a well bore extending from a ground surface into a hydrocarbon formation having a pressure, comprising:

(a) delivering into said well bore a concentric tubing string, said concentric tubing string comprising an inner tube means having an inner space therethrough and an outer tube means, said inner tube means and said outer tube means forming an annulus therebetween;

(b) introducing into said well bore a pressurized clean out medium through one of the said inner space and said annulus;

(c) removing said material and clean out medium through the other of the said inner space and said annulus to the surface of said well bore; and (d) providing a surface flow control means positioned at or near the surface of the well bore for preventing flow of hydrocarbon from a space between an outside wall of said outer tube means and a wall of said well bore.

138. The method of claim 137 wherein said pressurized clean out medium is introduced into said well bore at a pressure substantially equal to or below said pressure of the formation.

139. The method of claim 137 wherein said concentric tubing string is a concentric coiled tubing string.

140. The method of claim 137 wherein said concentric tubing string is a concentric drill pipe string.

141. A method for removing material from a well bore extending from a ground surface into a hydrocarbon formation having a pressure, comprising:

(a) delivering into said well bore a concentric tubing string, said concentric tubing string comprising an inner tube means having an inner space therethrough and an outer tube means, said inner tube means and said outer tube means forming an annulus therebetween;

(b) introducing into said well bore a pressurized clean out medium through one of the said inner space and said annulus;

(c) removing said material and clean out medium through the other of the said inner space and said annulus to the surface of said well bore; and (d) flaring hydrocarbon produced from the well bore by means of a flare means.

142. An apparatus for removing material from a well bore extending from a ground surface into a hydrocarbon formation having a pressure, comprising;

(a) a concentric tubing string having a top and a bottom, said concentric tubing string comprising an inner tube means having an inner space therethrough and an outer tube means, said inner tube means and said outer tube means forming an annulus therebetween;

(b) means for introducing into said well bore a pressurized clean out medium through one of the said inner space and said annulus;

(c) means for removing said material and clean out medium through the other of the said inner space and said annulus to the surface of said well bore; and (d) a downhole flow control means at or near the bottom of said concentric tubing string for preventing flow of hydrocarbon from the inner space, the annulus or both to the surface of the well bore.

143. The apparatus of claim 142 wherein said concentric tubing string is a concentric drill pipe string.

144. The apparatus of claim 142 wherein said concentric tubing string is a concentric coiled tubing string.

145. The apparatus of claim 142 further comprising a surface control means for controlling said downhole flow control means at the surface of said well bore.

146. The apparatus of claim 145 wherein said surface control means transmits a signal selected from the group consisting of an electric signal, a hydraulic signal, a pneumatic signal, a light signal or a radio signal.

147. An apparatus for removing material from a well bore extending from a ground surface into a hydrocarbon formation having a pressure, comprising;

(a) a concentric tubing string having a top and a bottom, said concentric tubing string comprising an inner tube means having an inner space therethrough and an outer tube means, said inner tube means and said outer tube means forming an annulus therebetween;

(b) means for introducing into said well bore a pressurized clean out medium through one of the said inner space and said annulus;

(c) means for removing said material and clean out medium through the other of the said inner space and said annulus to the surface of said well bore; and (d) a flare means operably connected to said removing means for flaring hydrocarbon produced from the well bore.

148. A method for removing material from a well bore extending from a ground surface into a hydrocarbon formation having a pressure, comprising:

(a) delivering into said well bore a single wall production tubing string, said production tubing string having a top and a bottom and an inside and an outside, said production tubing string forming an annulus between the outside of said production tubing string and a wall of said well bore;

(b) introducing into said well bore a pressurized clean out medium through one of the said inside of said production tubing string and said annulus;

(c) removing said material and clean out medium through the other of the said inside of said production tubing string and said annulus to the surface of said well bore; and (d) providing a downhole flow control means at or near the bottom of said production tubing string for preventing flow of hydrocarbon from the inside of the production tubing string to the surface of the well bore.

149. The method of claim 148 further comprising controlling said downhole flow control means at the surface of said well bore by a surface control means.

150. The method of claim 149 wherein said surface control means controls said downhole flow control means by transmitting a signal selected from the group consisting of an electric signal, a hydraulic signal, a pneumatic signal, a light signal or a radio signal.

151. A method for removing material from a well bore extending from a ground surface into a hydrocarbon formation having a pressure, comprising:

(a) delivering into said well bore a single wall production tubing string, said production tubing string having a cop and a bottom and an inside and an outside, said production tubing string forming an annulus between the outside of said production tubing string and a wall of said well bore;

(b) introducing into said well bore a pressurized clean out medium through one of the said inside of said production tubing string and said annulus;

(c) removing said material and clean out medium through the other of the said inside of said production tubing string and said annulus to the surface of said well bore; and (d) providing a surface flow control means positioned at or near the surface of the well bore for preventing flow of hydrocarbon from a space between the outside of the production tubing string and a wall of said well bore.

152. An apparatus for removing material from a well bore extending from a ground surface into a hydrocarbon formation having a pressure, comprising:

(a) a single wall production tubing string, said production tubing string having a top and a bottom and an inside and an outside, said production tubing string forming an annulus between the outside of said production tubing string and a wall of said well bore;

(b) means for introducing into said well bore a pressurized clean out medium through one of the said inside of said production tubing string and said annulus;

(c) means for removing said material and clean out medium through the other of the said inside of said production tubing string and said annulus to the surface of said well bore; and (d) a downhole flow control means at or near the bottom of said production tubing string for preventing flow of hydrocarbon from the inner space to the surface of the well bore.

153. The apparatus of claim 152 further comprising a surface control means for controlling said downhole flow control means at the surface of said well bore.

154. The apparatus of claim 153 wherein said surface control means transmits a signal selected from the group consisting of an electric signal, a hydraulic signal, a pneumatic signal, a light signal or a radio signal.

155. An apparatus for removing material from a well bore extending from a ground surface into a hydrocarbon formation having a pressure, comprising:

(a) a single wall production tubing string, said production tubing string having a top and a bottom and an inside and an outside, said production tubing string forming an annulus between the outside of said production tubing string and a wall of said well bore;

(b) means for introducing into said well bore a pressurized clean out medium through one of the said inside of said production tubing string and annulus;

(c) means for removing said material and clean out medium through the other of the said inside of said production tubing string and said annulus to the surface of said well bore; and (d) a surface flow control means positioned at or near the surface of the well bore for preventing flow of hydrocarbon from the annulus.

* * * * *

UNITED STATES PATENT AND TRADEMARK OFFICE

CERTIFICATE OF CORRECTION

PATENT NO. : 7,090,018 B2
APPLICATION NO. : 10/622582
DATED : August 15, 2006
INVENTOR(S) : James I. Livingstone It is certified that error appears in the above-identified patent and that said Letters Patent is hereby corrected as shown below:

On the title page, Assignee item 73 reads "Presgsol Ltd.". It should read --PressSol Ltd.--

Signed and Sealed this

Twelfth Day of December, 2006

JON W. DUDAS
*Director of the United States Patent and Trademark Office*